US010533707B2

(12) United States Patent
Shin et al.

(10) Patent No.: US 10,533,707 B2
(45) Date of Patent: Jan. 14, 2020

(54) GROUND LIQUEFIED NATURAL GAS STORAGE TANK AND METHOD FOR MANUFACTURING THE SAME

(71) Applicant: HYUNDAI HEAVY INDUSTRIES CO., LTD., Ulsan (KR)

(72) Inventors: Sang Beom Shin, Ulsan (KR); Dae Soon Kim, Ulsan (KR); In Soo Chun, Ulsan (KR); Dong Ju Lee, Ulsan (KR); Se Hwan Jeong, Daejeon (KR); Dong Kyu Shin, Ulsan (KR)

(73) Assignee: HYUNDAI HEAVY INDUSTRIES CO., LTD., Ulsan (KR)

( * ) Notice: Subject to any disclaimer, the term of this patent is extended or adjusted under 35 U.S.C. 154(b) by 329 days.

(21) Appl. No.: 15/127,661

(22) PCT Filed: Mar. 20, 2015

(86) PCT No.: PCT/KR2015/002775
§ 371 (c)(1),
(2) Date: Sep. 20, 2016

(87) PCT Pub. No.: WO2015/142126
PCT Pub. Date: Sep. 24, 2015

(65) Prior Publication Data

US 2017/0130898 A1 May 11, 2017

(30) Foreign Application Priority Data

Mar. 21, 2014 (KR) ..... 10-2014-0033606

(51) Int. Cl.
*E04B 1/32* (2006.01)
*F17C 3/02* (2006.01)
(Continued)

(52) U.S. Cl.
CPC ..... *F17C 3/02* (2013.01); *E04H 7/16* (2013.01); *F17C 13/001* (2013.01);
(Continued)

(58) Field of Classification Search
CPC .. F17C 3/00; F17C 3/02; F17C 13/001; F17C 2201/0157; F17C 2201/2203;
(Continued)

(56) References Cited

U.S. PATENT DOCUMENTS 4,069,642 A * 1/1978 Hendriks ..... F17C 3/022 52/223.2
4,426,817 A * 1/1984 Bomhard ..... F17C 3/04 52/262

(Continued)

FOREIGN PATENT DOCUMENTS

CN 101014799 A 8/2007
CN 102369386 A 3/2012

(Continued)

OTHER PUBLICATIONS

Extended European Search Report dated Sep. 11, 2017; Appln. 15764915.3

(Continued)

*Primary Examiner* — Andrew T Kirsch
*Assistant Examiner* — Elizabeth J Volz
(74) *Attorney, Agent, or Firm* — Ladas & Parry LLP

(57) ABSTRACT

The present invention includes: an independent tank constituting an inner tank to store a storage material therein; at least one sandwich plate modularized and manufactured include a metal plate provided in a pair opposite to each other, the metal plates having a reinforcing material formed therebetween, and a filler filled between the metal plates, the at least one sandwich plate surrounding the outer surface of the independent tank to constitute an outer tank; and an (Continued)

external reinforcing member formed on the outer surface of the sandwich plate.

11 Claims, 16 Drawing Sheets

(51) Int. Cl.
*E04H 7/16* (2006.01)
*F17C 13/00* (2006.01)

(52) U.S. Cl.
CPC ..... *F17C 2201/0157* (2013.01); *F17C 2203/012* (2013.01); *F17C 2203/035* (2013.01); *F17C 2203/0329* (2013.01); *F17C 2203/0341* (2013.01); *F17C 2203/0629* (2013.01); *F17C 2203/0636* (2013.01); *F17C 2203/0678* (2013.01); *F17C 2209/232* (2013.01); *F17C 2209/238* (2013.01); *F17C 2221/033* (2013.01); *F17C 2223/033* (2013.01); *F17C 2227/0135* (2013.01); *F17C 2260/042* (2013.01)

(58) Field of Classification Search
CPC ..... F17C 2201/012; F17C 2201/0329; F17C 2201/0341; F17C 2201/035; F17C 2201/0629; F17C 2201/0636; F17C 2201/0678; F17C 2209/232; F17C 2209/238; F17C 2221/033; F17C 2223/033; F17C 2227/0135; F17C 2260/042; E04H 7/16
USPC ..... 220/565, 901, 560.04, 560.12
See application file for complete search history.

(56) References Cited

U.S. PATENT DOCUMENTS

| | | | | |
|---|---|---|---|---|
| 4,519,415 | A * | 5/1985 | Carn | F17C 3/022 137/318 |
| 5,157,888 | A * | 10/1992 | Lindquist | B28B 7/22 264/71 |
| 8,020,721 | B2 | 9/2011 | Skovholt et al. | |
| 2011/0023408 | A1* | 2/2011 | Gulati | F17C 1/00 52/742.14 |

FOREIGN PATENT DOCUMENTS

| | | | | |
|---|---|---|---|---|
| JP | 55-145899 | A | 11/1950 | |
| JP | 60-044694 | A | 3/1985 | |
| JP | 2000-159290 | A | 6/2000 | |
| JP | 2001-180793 | A | 7/2001 | |
| KR | 1020120013257 | A | 2/2012 | |
| KR | 1020130134042 | A | 12/2013 | |
| KR | 101362746 | B1 | 2/2014 | |
| WO | 2006/001709 | A2 | 1/2006 | |
| WO | WO2006001709 | * | 1/2006 | F17C 3/04 |

OTHER PUBLICATIONS

International Search Report dated Jun. 15, 2015; PCT/KR2015/002775.

* cited by examiner

GROUND LIQUEFIED NATURAL GAS STORAGE TANK AND METHOD FOR MANUFACTURING THE SAME

TECHNICAL FIELD

The present invention relates a ground liquefied natural gas storage tank and a method for manufacturing the same.

BACKGROUND ART

In general, a liquefied natural gas storage tank is used to store or transport cryogenic liquefied natural gas (LNG) of about −165° C. The liquefied natural gas storage tank is classified into a terrestrial storage tank (including a ground storage tank, a buried tank, and a semi-buried storage tank) which is installed on the ground or buried in the ground according to installation positions, and a mobile storage tank which is mounted on transportation means such as vehicles and ships.

Here, since the LNG storage tank stores LNG in a cryogenic state, there is a danger of explosion when the LNG storage tank is exposed to impact. For this reason, the structure of the LNG storage tank should satisfy conditions such as impact resistance and sealing performance. In order to satisfy such conditions, the LNG storage tank is configured to have a multi-layer wall structure. That is, the LNG storage tank includes a external tank (outer tank) in which a storage space is formed, an internal tank (inner tank) which directly contacts the LNG and seals the LNG, and a perlite interposed between the external tank and the internal tank to heat-insulate the LNG.

In particular, the ground storage tank included in the terrestrial storage tank is generally built as follows.

First, as a foundation construction for solidifying the ground, iron pipe wedges are hit on the ground, and concrete is poured on the ground so as to prevent earthquake or impact. After that, a construction is performed on a cylindrical side wall for determining the storage capacity of the ground storage tank on the basis of the foundation construction. Here, the construction of the side wall may be performed by injecting concrete into a mold and then removing the mold after the concrete (constituting an outer tank) is solidified. After that, the inner wall and bottom of the side wall are provided with a heat insulating panel, an internal tank is built inside the concrete outer tank, and a finishing process is then performed on the internal tank.

As described above, if the ground storage tank is constructed using the side wall, the concrete and the heat insulating panel cannot be built at the same time. Therefore, much time and manpower is required to build the concrete using the mold and then form the heat insulating panel on the concrete.

PRIOR ART DOCUMENTS

Patent Documents

Japanese Patent Laid-open Publication No. 2000-159290 (Jun. 13, 2000)

Japanese Patent Laid-open Publication No. 2001-180793 (Jul. 3, 2001)

DISCLOSURE

Technical Problem

The present invention is conceived to solve the aforementioned problems. Accordingly, an object of the present invention is to provide a ground liquefied natural gas storage tank and a method for manufacturing the same, which can enhance the heat insulation performance, impact resistance, and durability of the ground liquefied natural gas storage tank by using a sandwich plate in construction of the ground liquefied natural gas storage tank, and reduce a construction term by easily performing the construction of the ground liquefied natural gas storage tank.

Another object of the present invention is to provide a ground liquefied natural gas storage tank and a method for manufacturing the same, in which an external reinforcing member is additionally provided to an outer tank using a sandwich plate, so that it is possible to enhance the heat insulation performance, impact resistance, and durability of the ground liquefied natural gas storage tank and to reduce the weight of the ground liquefied natural gas storage tank, thereby modularizing and manufacturing the ground liquefied natural gas storage tank and thus saving construction cost.

Still another object of the present invention is to provide a ground liquefied natural gas storage tank and a method for manufacturing the same, in which as an outer tank is modularized, a production site and an installation site are distinguished from each other, so that it is possible to realize reduction in construction term required to manufacture the ground liquefied natural gas storage tank, reduction in required labor, and the like.

Technical Solution

According to an aspect of the present invention, there is provided a ground liquefied natural gas storage tank including: an independent tank in which a space for storing a storage material is formed to constitute an inner tank; at least one sandwich plate modularized and manufactured to include a metal plate provided in a pair opposite to each other, the metal plates having a reinforcing material formed therebetween, and a filler filled between the metal plates, the at least one sandwich plate surrounding the outer surface of the independent tank to constitute an outer tank; and an external reinforcing member formed on an outer surface of the sandwich plate.

Specifically, the independent tank may be located over a heat insulation structure installed on the ground in a state in which the independent tank has been completely manufactured, and the modularized sandwich plate may be transported and then installed to surround the outer surface of the independent tank that has been completely manufactured.

Specifically, the independent tank may include a holding part formed to extend outward from the bottom at a lower corner of the independent tank.

Specifically, the independent tank may include a holding part formed outward of a surface connected to the heat insulation structure.

Specifically, the ground liquefied natural gas storage tank may further include an outer tank slab constituting the outer tank together with the sandwich plate by covering the bottom of the sandwich plate.

Specifically, the ground liquefied natural gas storage tank may further include an outer tank slab reinforcing member formed as a frame on the outer surface of the outer tank slab.

Specifically, the ground liquefied natural gas storage tank may further include at least one support supporting the outer tank slab from the ground.

Specifically, the support may be an elevated type support, and may be a bar type, H-beam type or pipe type support, or a pile.

Specifically, the supports may be installed to be spaced apart from each other, and the spacing distance between a column of supports facing a column of outermost supports among the supports installed to be spaced apart from each other and the column of outermost supports may be equal to or greater than the left-right length of a transportation means.

Specifically, the ground liquefied natural gas storage tank may further include a pump tower installed in the independent tank to discharge the storage material upward from the bottom of the independent tank.

Specifically, the independent tank may have a rectangular parallelepiped shape or a cylindrical shape.

Specifically, the ground liquefied natural gas storage tank may further include a perlite provided between the independent tank and the sandwich plate.

According to an aspect of the present invention, there is provided a method for manufacturing a ground liquefied natural gas storage tank, the method including: installing at least one support extending upward from the ground; installing an outer tank slab over the support; installing an inner tank over the outer tank slab; and installing at least one sandwich plate to surround the inner tank along the circumferential surface of the outer tank slab, wherein the sandwich plate includes an external reinforcing member formed on the outer surface thereof.

Specifically, the method may further include: manufacturing the inner tank; modularizing and manufacturing the sandwich plate; transporting the inner tank to an installation site; and transporting the sandwich plate to the installation site.

Specifically, the installing of the inner tank may include transporting the inner tank over the outer tank slab using a transportation means.

Specifically, the method may further include: installing an arbitrary support extending upward from the ground; transporting the inner tank to the arbitrary support using a transportation means; installing a holding part at the inner tank; and transporting the inner tank over the outer tank slab using the transportation means or another transportation means.

Specifically, in the transporting of the inner tank over the outer tank slab, the inner tank may be transported over the outer tank slab by moving the transportation means or the another transportation means along the outside of the outer tank slab.

Specifically, the installing of the outer tank slab may include: transporting the outer tank slab to the support; and assembling the outer tank slab.

Specifically, the installing of the sandwich plate may include: transporting the sandwich plate to the outer tank slab; and assembling the sandwich plate.

Specifically, the method may further include installing a perlite between the inner tank and the sandwich plate.

Specifically, the manufacturing of the sandwich plate may further include: forming a metal plates provided in a pair opposite to each other, the metal plates having a reinforcing material formed therebetween; and filling a filler between the metal plates.

Advantageous Effects

In the ground liquefied natural gas storage tank and the method for manufacturing the same according to the present invention, the sandwich plate can be modularized and constructed without installing or dismantling any separate mold. Thus, the number of processes for installation is decreased, and the required labor is reduced, thereby saving cost and reducing a construction term. Accordingly, it is possible to easily install the ground liquefied natural gas storage tank even in severe cold regions such as polar regions, and regions in which manpower supply is insufficient.

In addition, the external reinforcing member is added to the sandwich plate, so that it is possible to enhance the durability or impact resistance of the sandwich plate and to remarkably reduce the weight of the sandwich plate. Accordingly, the modularized construction method can be efficiently performed, and simultaneously, material cost can be reduced, thereby saving construction cost.

In addition, the thickness of the sandwich plate can be decreased, so that it is possible to simply and easily install a hole for discharging a storage material to the outside therethrough.

MODE FOR THE INVENTION

Figure 1:
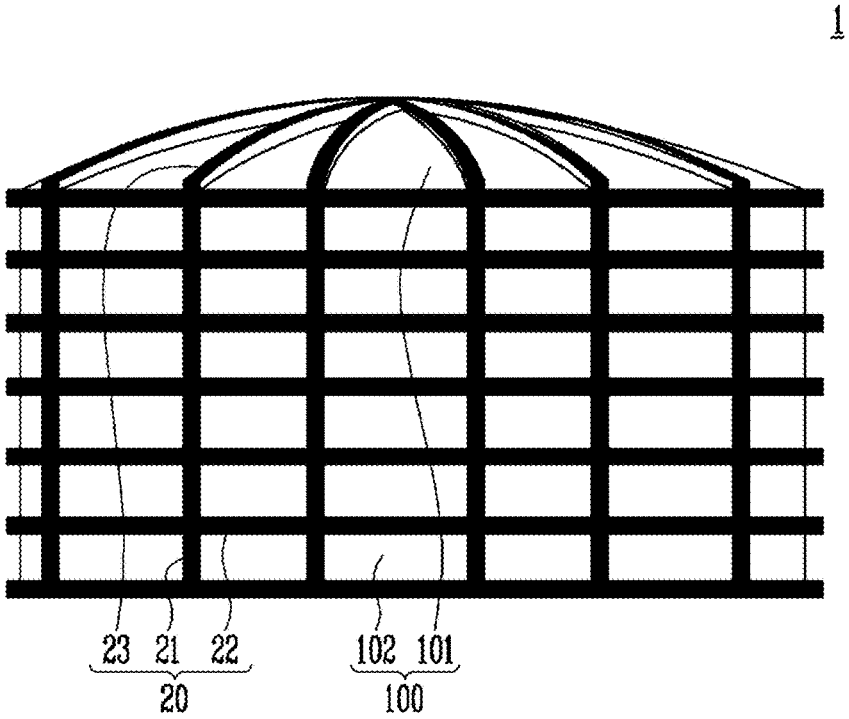
FIG. 1 is a front view of a ground liquefied natural gas storage tank according to a first embodiment of the present invention.

Objects, specific advantages, and novel features of the invention will become more apparent from the following detailed description and exemplary embodiments when taken in conjunction with the accompanying drawings. In this specification, it should note that in giving reference numerals to elements of each drawing, like reference numerals refer to like elements even though like elements are shown in different drawings. In the following description, detailed explanation of known related functions and constitutions may be omitted to avoid unnecessarily obscuring the subject manner of the present invention.

Hereinafter, exemplary embodiments of the present invention will be described in detail with reference to the accompanying drawings.

Figure 2:
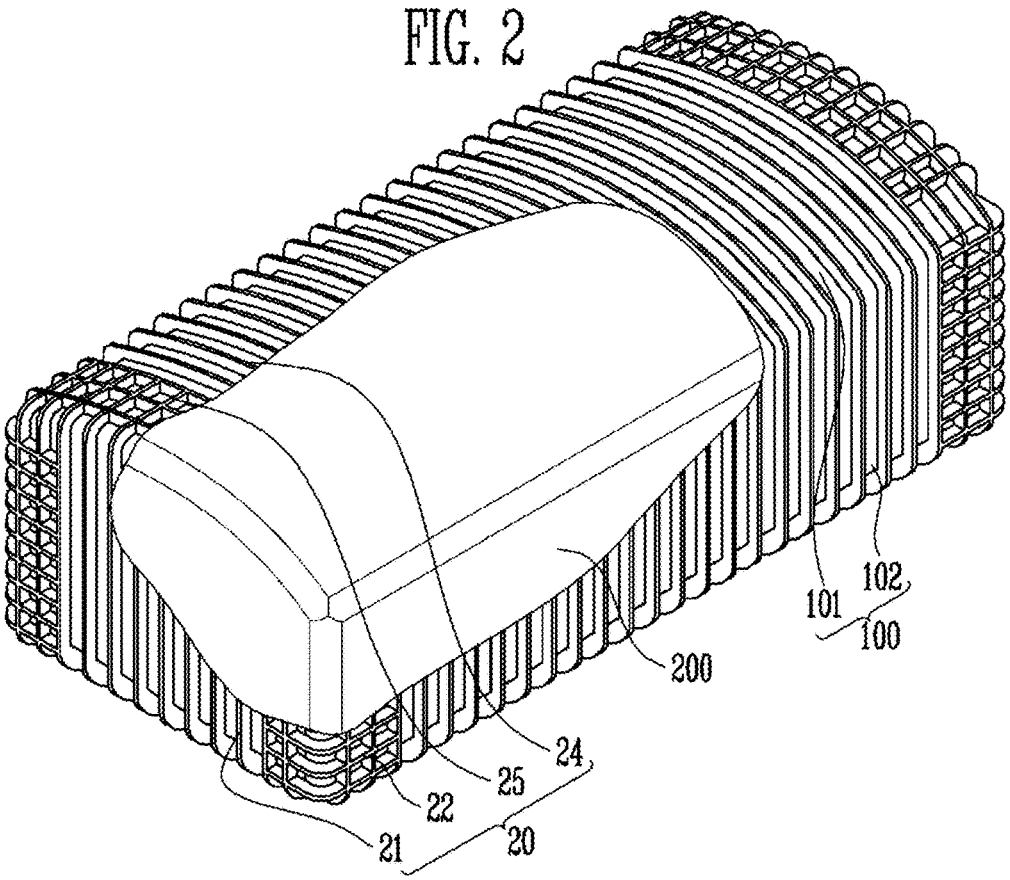
FIG. 2 is a perspective view reflecting an inside of a ground liquefied natural gas storage tank according to a second embodiment of the present invention.
Figure 3:
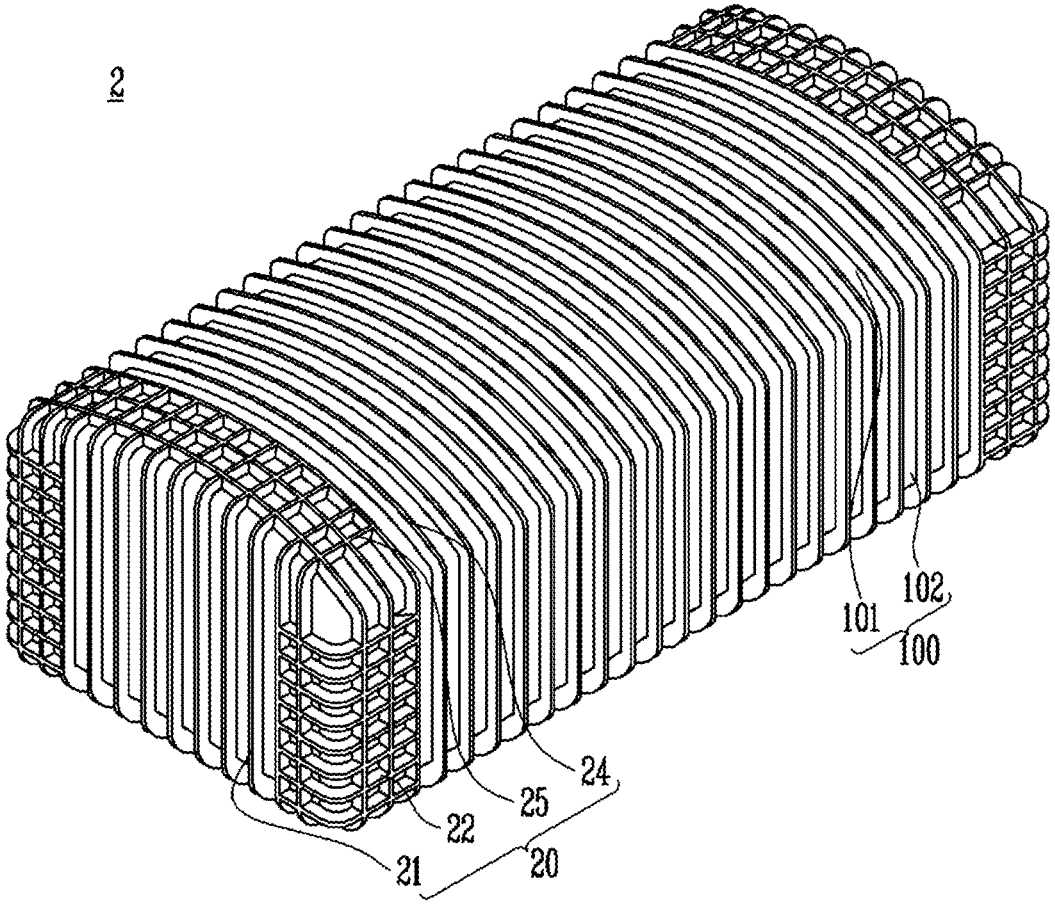
FIG. 3 is a perspective view of the ground liquefied natural gas storage tank according to the second embodiment of the present invention.
Figure 4:
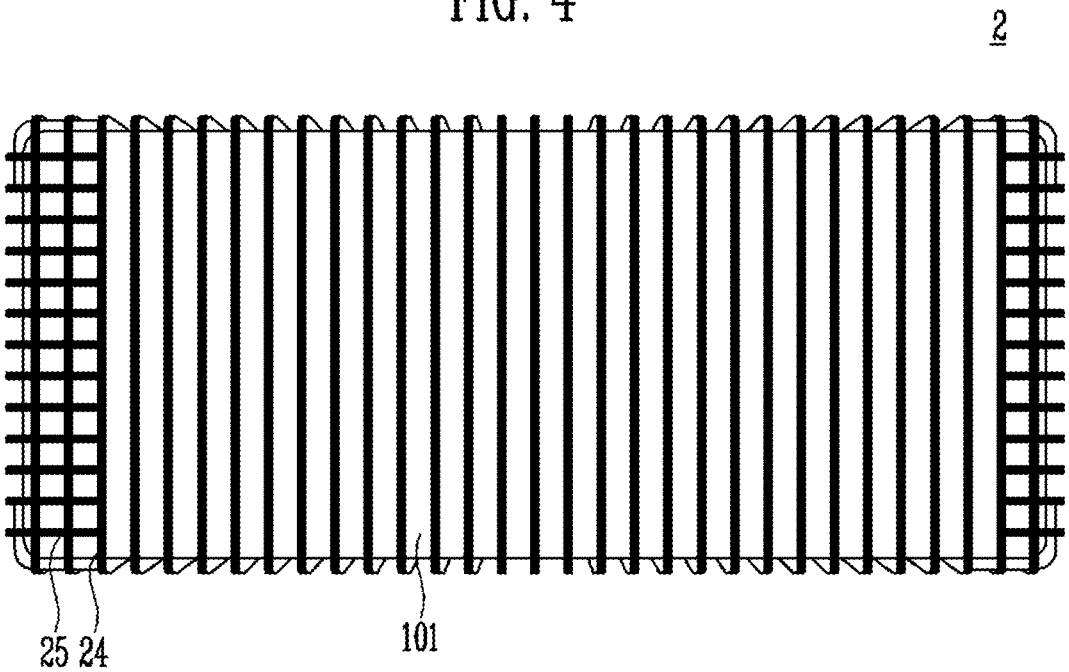
FIG. 4 is a plan view of the ground liquefied natural gas storage tank according to the second embodiment of the present invention.
Figure 5:
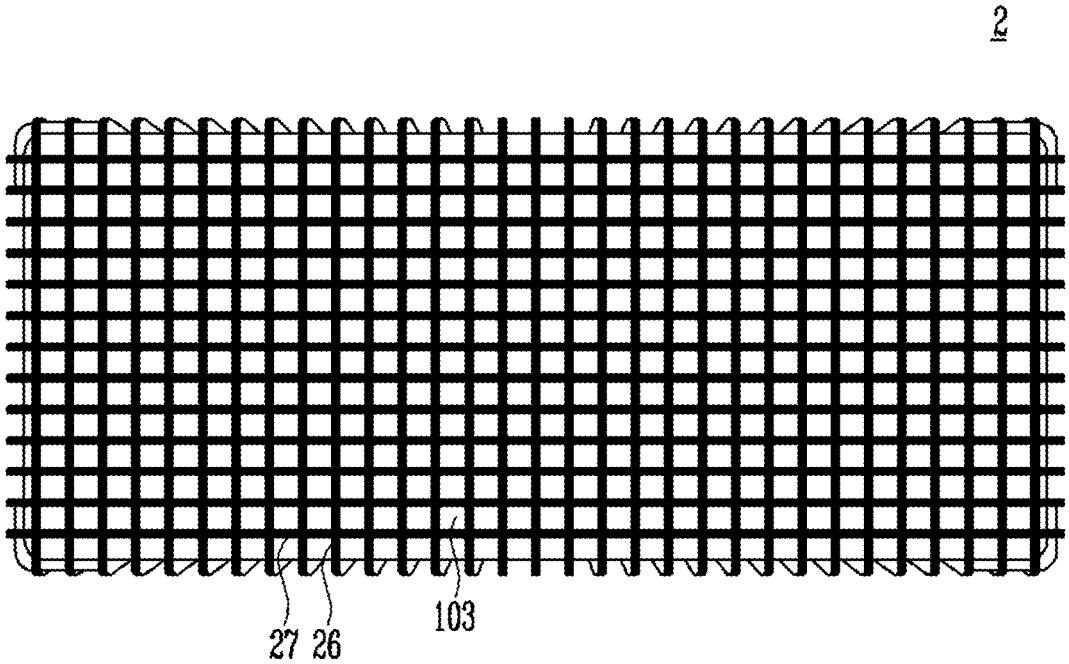
FIG. 5 is a bottom view of the ground liquefied natural gas storage tank according to the second embodiment of the present invention.
Figure 6:
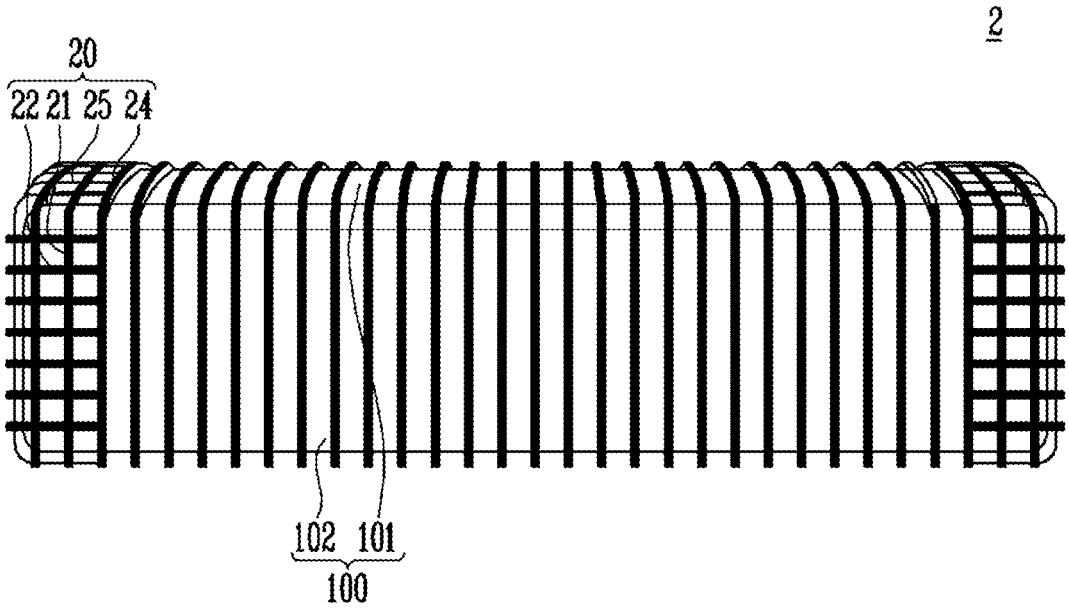
FIG. 6 is a side view of the ground liquefied natural gas storage tank according to the second embodiment of the present invention.
Figure 7:
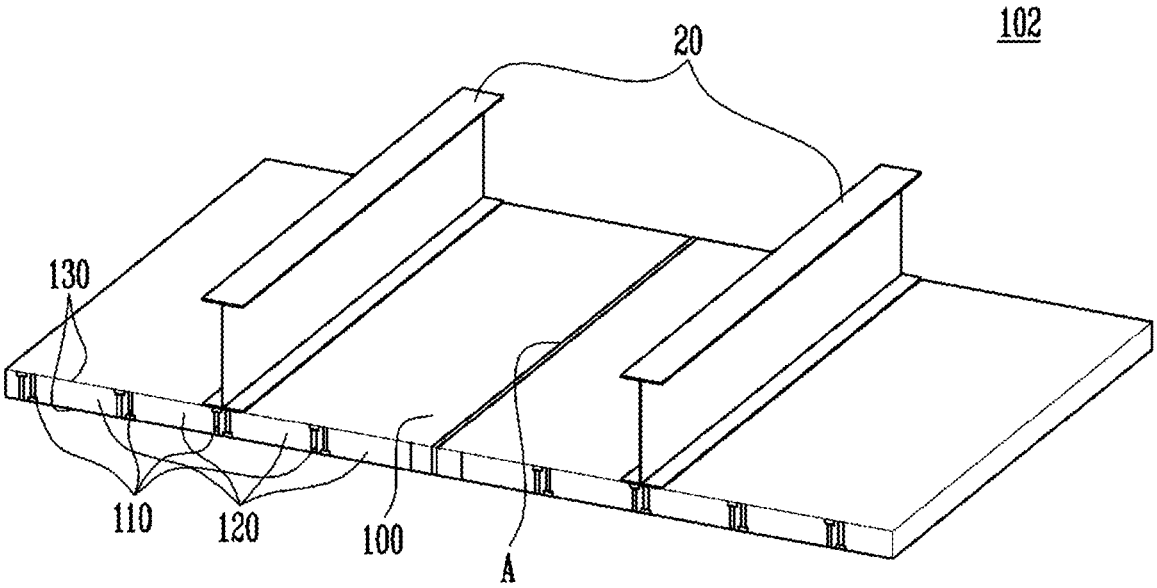
FIG. 7 is a configuration view of a sandwich plate according to an embodiment of the present invention.
Figure 8A:
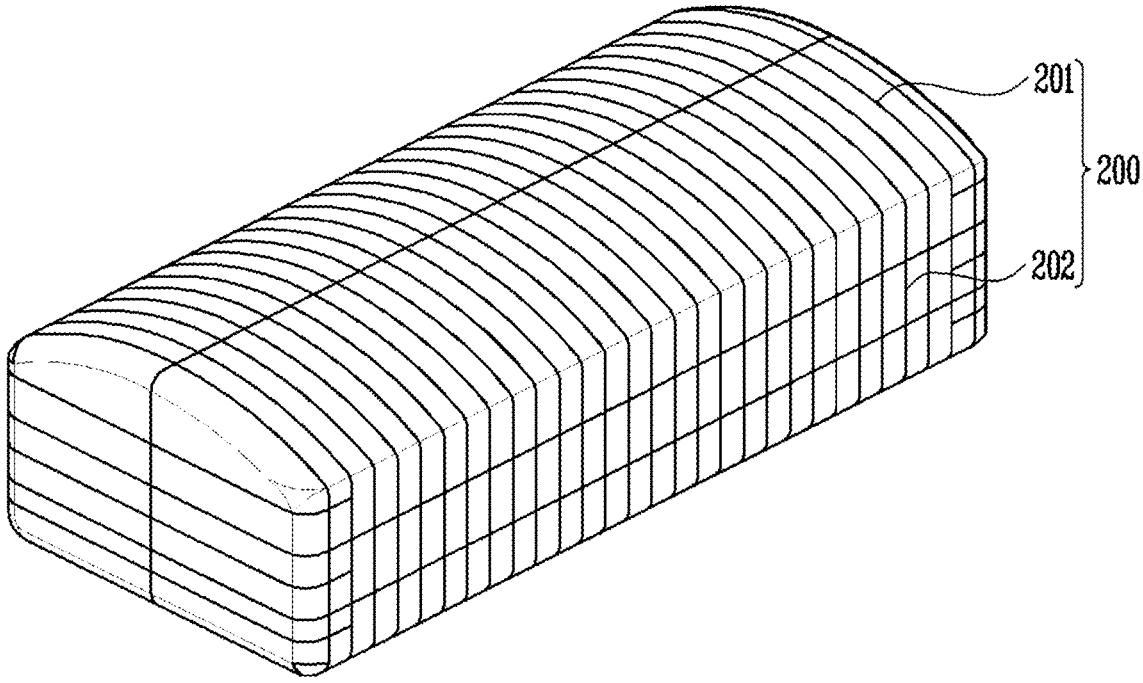
FIG. 8A is a perspective view of an inner tank according an embodiment of the present invention.
Figure 8B:
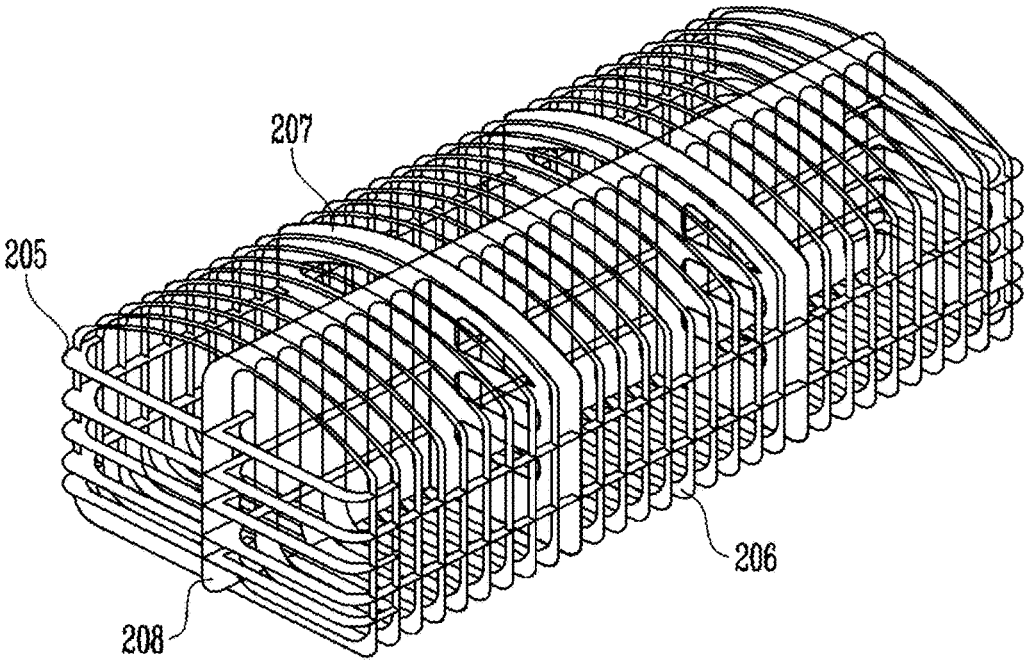
FIG. 8B is an internal perspective view of the inner tank according to the embodiment of the present invention.
Figure 8C:
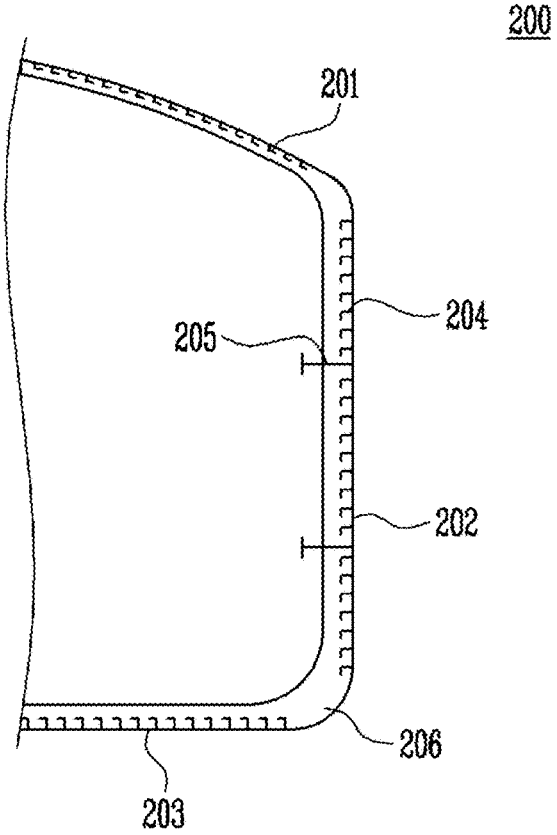
FIG. 8C is a sectional view of the inner tank according to the embodiment of the present invention.
Figure 9A:
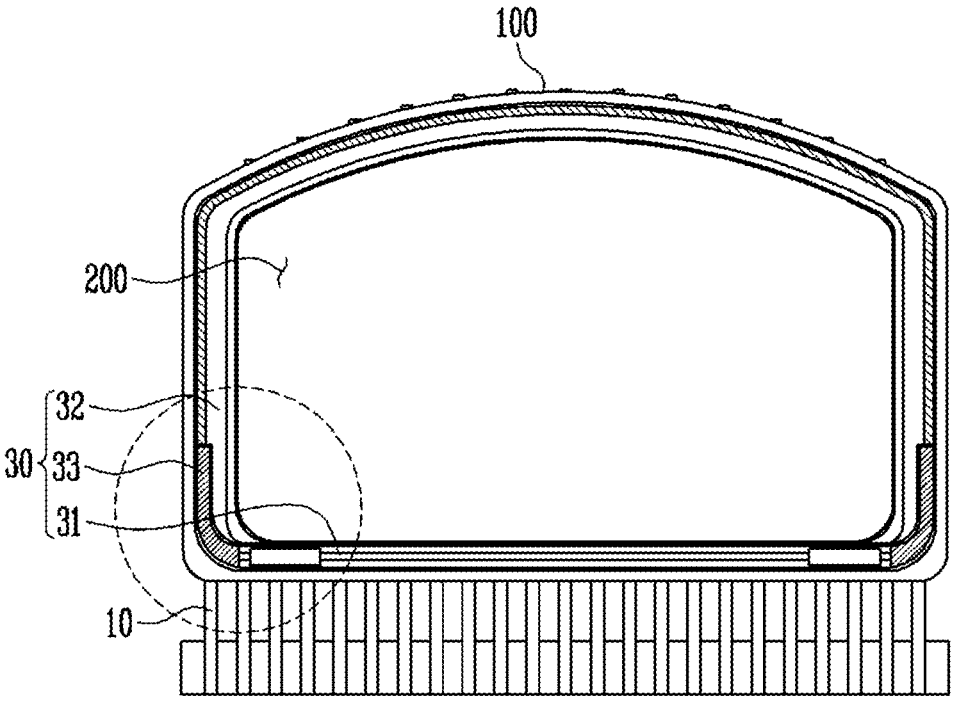
FIG. 9A is a sectional view of a ground liquefied natural gas storage tank according to an embodiment of the present invention.
Figure 9B:
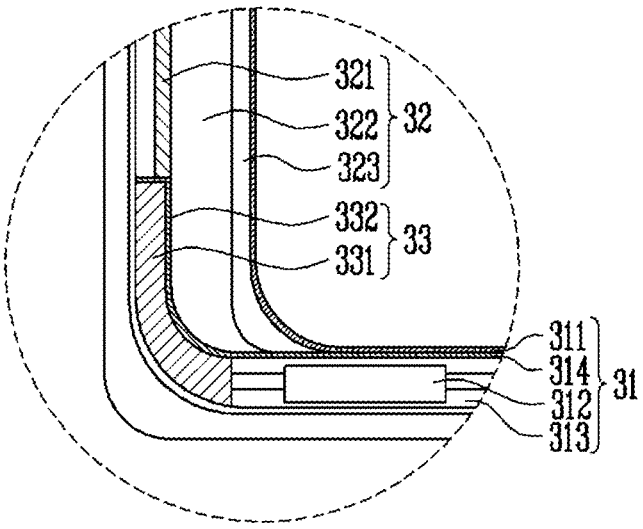
FIG. 9B is a partial detail view of a heat insulating part of the ground liquefied natural gas storage tank according to the embodiment of the present invention.
Figure 10:
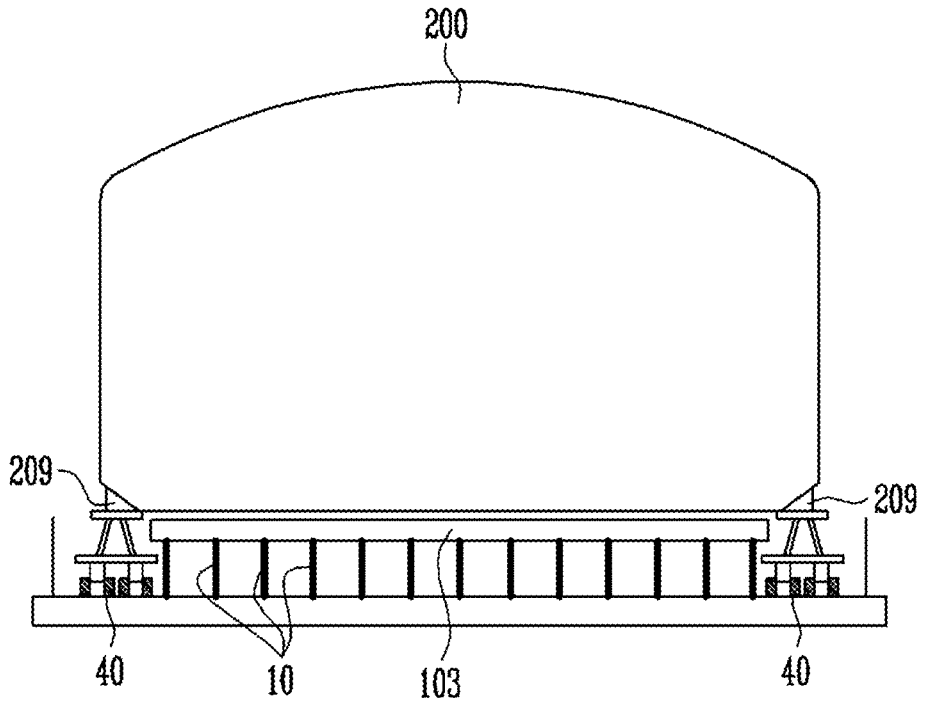
FIG. 10 is a conceptual view illustrating when a ground liquefied natural gas storage tank is installed by a transportation means according to the embodiment of the present invention.

FIG. 1 is a front view of a ground liquefied natural gas storage tank according to a first embodiment of the present invention. FIG. 2 is a perspective view reflecting an inside of a ground liquefied natural gas storage tank according to a second embodiment of the present invention. FIG. 3 is a perspective view of the ground liquefied natural gas storage tank according to the second embodiment of the present invention. FIG. 4 is a plan view of the ground liquefied natural gas storage tank according to the second embodiment of the present invention. FIG. 5 is a bottom view of the ground liquefied natural gas storage tank according to the second embodiment of the present invention. FIG. 6 is a side view of the ground liquefied natural gas storage tank according to the second embodiment of the present invention. FIG. 7 is a configuration view of a sandwich plate according to an embodiment of the present invention. FIG. 8A is a perspective view of an inner tank according an embodiment of the present invention. FIG. 8B is an internal perspective view of the inner tank according to the embodiment of the present invention. FIG. 8C is a sectional view of the inner tank according to the embodiment of the present invention. FIG. 9A is a sectional view of a ground liquefied natural gas storage tank according to an embodiment of the present invention. FIG. 9B is a partial detail view of a heat insulating part of the ground liquefied natural gas storage tank according to the embodiment of the present invention. FIG. 10 is a conceptual view illustrating when a ground liquefied natural gas storage tank is installed by a transportation means according to the embodiment of the present invention.

As shown in FIGS. 1 to 10, each of the ground liquefied natural gas storage tanks 1 and 2 according to the first and second embodiments of the present invention includes an outer tank 100 and an inner tank 200.

Hereinafter, a production site and an installation site are used together with a production place and an installation place. In addition, a transportation means 40 which will be described later may be a transportation means generally used in shipbuilding, such as a ship, a transporter, an SPMT, a lifter, or a crane, and therefore, its description is omitted.

In order for each of the ground liquefied natural gas storage tanks 1 and 2 according to the first and second embodiments of the present invention to be installed on an installation site (not shown), a bottom (not shown) may be formed on the ground (reference numeral not shown). Although not shown in these figures, the bottom may be made by forming iron pipe wedges (not shown) and a concrete material on the ground so as to prevent earthquake or impact.

In addition, each of the ground liquefied natural gas storage tanks 1 and 2 according to the first and second embodiments of the present invention may include a foam board (not shown) for preventing the temperature of a liquid stored in the inner tank 200 which will be described later to be transported to the ground. The foam board may be formed by foaming synthetic resin.

The bottom and the foam board will be described in a manufacturing method which will be described later.

The outer tank 100 may be provided to surround the circumference of the inner tank 200 which will be described later. The outer tank 100 may include an outer tank roof 101, a sandwich plate 102, and an outer tank slab 103.

The outer tank roof 101 may be installed such that the sandwich plate 102 which will be described later is closed at an upper portion of the inner tank 200. Here, like the sandwich plate 102, the outer tank roof 101 may be formed in the shape of a sandwich concrete plate (SCP). The outer tank roof 101 may be installed to be modularized and manufactured in the shape of the SCP. In addition, the outer tank roof 101 may be installed to be directly manufactured on the installation site (not shown), and it will be apparent that the outer tank roof 101 may be installed to be manufactured in another form.

The sandwich plate 102 will be described with reference to FIG. 7. FIG. 7 is a configuration of a sandwich plate according to an embodiment of the present invention. Referring to FIG. 7, the sandwich plate 102 is modularized and manufactured to include a pair of steel plates 130 facing each other, the pair of steel plates 130 having a reinforcing material (preferably, a front connecting member 110 which will be described later) formed therebetween, and a concrete 120 filled between the steel plates 130. Thus, at least one sandwich plate is provided to constitute an outer tank by surrounding the outer surface of the inner tank 200.

The front connecting member 110 may be connected through a technique such as welding to form multiple layers between the steel plates 130. The front connecting member 110 connects the pair of steel plates 130 to each other, to simplify the structure of the sandwich plate 102 and to improve the resistance against fatigue and corrosion with respect to the sandwich plate 102.

The front connecting member 110 enables the concrete 120 to be maintained between the two steel plates 130 facing each other such that a concrete material and an iron material, which are heterogeneous materials, can constitute one member to be integrally transported.

The concrete 120 may be a filler filled between the steel plates 130. It is generally known that the material of the concrete has a property strong against compression, and the heat insulation performance is excellent. A pre-stressed concrete may be used as the concrete 120. Since stretched iron cores (not shown) are embedded in the material of the concrete 120 before the material of the concrete 120 is consolidated, a compressive residual stress is generated by the stretched iron cores, and therefore, a change in shape, caused by a force (tensile force) with which the material of the concrete 120 is pulled to the outside, is decreased by the compressive residual stress. Here, the iron cores (not shown) embedded in the material of the concrete 120 may be provided to be spaced apart from each other along the length direction of the front connecting member 110 formed between the steel plates 130.

The steel plate 130 is a component for guiding the shape of the concrete 120 such that the sandwich plate 102 constitutes a wall body. The steel plate 130 is provided in a pair opposite to each other, and the front connecting member 110 is formed between the pair of steel plates 130. For example, the steel plate 130 is formed in the shape of a plate made of an iron material, and the front connecting member 110 made of iron is provided in plurality to cross between the pair of plates, thereby enhancing the stiffness of the sandwich plate 102.

The sandwich plate 102 may be transported so as to surround the outer surface of the inner tank 200 which has been completely manufactured and then be installed by performing welding along a welding line A between the sandwich plates 102.

Each of the ground liquefied natural gas storage tanks 1 and 2 according to the first and second embodiments of the present invention may include an external reinforcing member 20 formed on the outer surface of the sandwich plate 102. The external reinforcing member 20 may include first and second external reinforcing members 21 and 22 installed at the sandwich plate 102, third, fourth, and fifth external reinforcing members 23, 24, and 25 installed at the outer tank roof 101, and sixth and seventh external reinforcing members 26 and 27 installed at the outer tank slab 103. The external reinforcing member 20 may be formed of steel.

The first external reinforcing member 21 may be provided to the sandwich plate 102 that is a side portion of the outer tank 100. The first external reinforcing member 21 may be a longitudinal reinforcing member. The second external reinforcing member 22 may be provided to the sandwich plate 102 to be at right angles to the first external reinforcing member 21. The second external reinforcing member 22 may be a lateral reinforcing member.

The third external reinforcing member 23 may be provided to the outer tank roof 101 that is a lid of the outer tank 100 of the ground liquefied natural gas storage tank 1 according to the first embodiment of the present invention. The ground liquefied natural gas storage tank 1 according to the first embodiment of the present invention has a cylindrical shape, and the reinforcing members installed at the outer tank roof 101 may be provided in a shape in which they are gathered at an arbitrary one point of the outer tank roof 101.

The fourth and fifth external reinforcing members 24 and 25 may be provided to the outer tank roof 101 that is a lid of the outer tank 100 of the ground liquefied natural gas storage tank 2 according to the second embodiment of the present invention. The fourth and fifth external reinforcing members 24 and 25 may be installed to be at right angles to each other. The fourth and fifth external reinforcing members 24 and 25 may be configured such that the first or second external reinforcing member 21 or 22 extends to be connected thereto.

The sixth and seventh external reinforcing members 26 and 27 may be provided to the outer tank slab 103 that is a bottom of the outer tank 100. The sixth and seventh external reinforcing members 26 and 27 may be installed to be at right angles to each other. The sixth and seventh external reinforcing members 26 and 27 may be configured such that the first or second external reinforcing member 21 or 22 extends to be connected thereto.

The positions, lengths, and shapes of the first to seventh external reinforcing members 21 to 27 may be flexibly changed depending on designs under conditions such as stiffness, durability, and impact resistance of the outer tank 100.

When the reinforcing member is installed inside the outer tank 100, the reinforcing member may come in contact with a storage material (e.g., liquefied natural gas (LNG)) stored in the inner tank 200 (e.g., a case where the storage material is leaked as the inner tank 200 is broken), and hence a reinforcing member having a specific property is to be provided. Therefore, cost required to purchase the reinforcing member is increased. Accordingly, in each of the ground liquefied natural gas storage tanks 1 and 2 according to the first and second embodiments of the present invention, the reinforcing member is not installed inside the outer tank 100 but installed outside the outer tank 100. Thus, cost required to install the reinforcing member is decreased, and the risk due to the contact of the reinforcing member with the storage material stored in the inner tank 200 is also decreased.

In order to enable each of the ground liquefied natural gas storage tanks 1 and 2 according to the first and second embodiments of the present invention to be installed in a field after it is modularized and then transported to the field, it is essential to maintain or improve the original function, object, and effect of the sandwich plate 102 and simultaneously lighten the weight of the sandwich plate 102.

Accordingly, in the embodiments of the present invention, the external reinforcing member 20 is installed at a part (preferably, the sandwich plate 102) of each of the ground liquefied natural gas storage tanks 1 and 2, so that it is possible to improve the durability, noise insulation and impact resistance of the part and simultaneously lighten the weight of the part. Thus, each of the ground liquefied natural gas storage tanks 1 and 2 can be installed in a field after it is modularized and then transported to the field. In addition, it is possible to improve the durability, noise insulation and impact resistance of the ground liquefied natural gas storage tank and simultaneously lighten the weight of the ground liquefied natural gas storage tank.

The lightening effect due to the installation of the external reinforcing member 20 will be described with reference to the following table.

TABLE 1

| | Weight of LNG tank of 200,000 $m^3$ (Tons) | |
|---|---|---|
| | Conventional tank | Tank of present invention |
| Inner tank | 3,435 (including steel roof) | 4,656 |
| Outer tank | 48,073 | 16,021 |
| Total | 51,508 | 20,677 |
| Ratio | 1.0 | 0.4 |

Table 1 is a table showing values obtained by comparing weights of a conventional tank and a tank of the present invention. Referring to Table 1, it can be seen that the weight of the outer tank 100 occupies a considerable portion of the total weight of an LNG tank of 200,000 m3. Thus, in each of the ground liquefied natural gas storage tanks 1 and 2 according to the present invention, the outer tank 100 is modularized, and the external reinforcing member 20 is additionally provided to the outer tank 100, so that the weight of the outer tank 100 can be effectively lightened (about 40%) as shown in Table 1.

Accordingly, in the first and second embodiments of the present invention, the outer tank 100 is modularized and manufactured on a production site (not shown), and then all components of each of the ground liquefied natural gas storage tanks 1 and 2 are transported to an installation place and then assembled in the installation place, thereby completing each of the ground liquefied natural gas storage tanks 1 and 2. Thus, it is possible to remarkably reduce a construction term, to effectively solve the problem of manpower supply, and to considerably save construction cost.

The sandwich plate 102 can be assembled at the same time when the bottom or the inner tank 200 is formed in a process of making each of the ground liquefied natural gas storage tanks 1 and 2, or the previously assembled sandwich plate 102 can be used, so that it is possible to reduce a construction term and to save cost.

Furthermore, the durability, noise insulation, and fire resistance of the sandwich plate 102 is high as compared with a wall body made of a general cement material, and hence it can be minimized that an external stimulus is delivered to a liquid stored in the inner tank 200 or that the temperature of the liquid is delivered to the outside. The sandwich plate 102 uses the construction efficiency of the steel plate 130 and the high stiffness of the material of the concrete 120, thereby obtaining excellent construct ability and structural rationality.

That is, when the storage material stored in the inner tank 200 is liquefied natural gas (LNG), the LNG has a danger of explosion when the LNG is exposed to impact, and is to be stored in a cryogenic state. Hence, each of the ground liquefied natural gas storage tanks 1 and 2 which store the LNG forms a structure in which the impact resistance and liquid tightness of the sandwich plate 102 are firmly maintained.

The outer tank slab 103 covers the bottom of the sandwich plate 102, thereby constituting an outer tank together with the sandwich plate 102. Here, the outer tank slab 103 may be installed to be modularized and manufactured in the shape of an SCP, or may be directly manufactured and installed on an installation site (not shown). The outer tank slab 103 can be flexibly changed depending on an installation plan, and thus is not limited to the contents described in the embodiments.

Therefore, in each of the ground liquefied natural gas storage tanks 1 and 2 according to the first and second embodiments of the present invention, an outer tank slab reinforcing member (preferably, the sixth or seventh external reinforcing member 26 or 27) may be proved at the outer tank slab 103 so as to modularize and transport the outer tank slab 103.

In the first and second embodiments of the present invention, the outer tank slab reinforcing members 26 and 27 are provided to the outer tank slab 103, so that the strength, durability, and heat insulation of the outer tank slab 103 are improved. On the other hand, the weight of the outer tank slab 103 is reduced, and the thickness of the outer tank slab 103 is decreased. Accordingly, the process of modularizing and then transporting the outer tank slab 103 can be efficiently performed.

The outer tank slab 103 may further include at least one support 10 for supporting the outer tank slab 103 from the ground.

The support 10 may be an elevated type support. The support 10 may be a bar type, H-beam type or pipe type support, or a pile. In addition, the supports 10 may be installed to be spaced apart from each other, and the spacing distance between a support (reference numeral not shown) facing each of both outermost supports (reference numeral not shown) among the supports 10 installed to be spaced apart from each other and the outermost support may be equal to or greater than the left-right length of the transportation means 40.

Each of the ground liquefied natural gas storage tanks 1 and 2 according to the first and second embodiments of the present invention may include a heat insulating part 30. The heat insulating part 30 may include a bottom heat insulating part 31, a side heat insulating part 32, and a corner heat insulating part 33. When the storage material of each of the ground liquefied natural gas storage tanks 1 and 2 is liquefied natural gas, the liquefied natural gas is liquefied at a temperature of about −163° C., and therefore, the storage tank is to maintain a cryogenic state when the liquefied natural gas is stored in a liquid state.

Accordingly, each of the ground liquefied natural gas storage tanks 1 and 2 storing the liquefied natural gas requires a structure for minimizing heat conduction to the outside and heat absorption to the inside. To this end, each of the ground liquefied natural gas storage tanks 1 and 2 may include the heat insulating part 30. This will be described with reference to FIG. 9.

FIG. 9A is a sectional view of a ground liquefied natural gas storage tank according to an embodiment of the present invention. FIG. 9B is a partial detail view of a heat insulating part of the ground liquefied natural gas storage tank according to the embodiment of the present invention.

Referring to FIG. 9A, each of the ground liquefied natural gas storage tanks 1 and 2 installed to be spaced apart from the ground at a certain distance by a plurality of supports 10 has a double-barrier tank structure by installing an inner tank 200 for storing a storage material therein and installing an outer tank 100 outside the inner tank 200 so as to maximize the heat insulation of the storage material. In addition, each of the ground liquefied natural gas storage tanks 1 and 2 has a structure in which a perlite is filled between the inner tank 200 and the outer tank 100.

The above-described structure represents a macroscopic heat insulation structure, and the bottom and side heat insulation structure of each of the ground liquefied natural gas storage tanks 1 and 2 will be described in detail below with reference to FIG. 9B.

Referring to FIG. 9B, the bottom and side heat insulation structure of each of the ground liquefied natural gas storage tanks 1 and 2 may include a bottom heat insulating part 31, a side heat insulating part 32, and a corner heat insulating part 33.

The bottom heat insulating part 31 may function to heat-insulate between the bottom of the inner tank 200 and the bottom of the outer tank 100. The bottom heat insulating part 31 has a layer structure in which the inner tank 200, a screed 311, a cellular glass foam (CGF) board 313, and the outer tank 100 are sequentially stacked in the direction toward the ground from the inner tank 200, thereby performing a heat insulating function. A bottom protection 314 may be interposed between the screed 311 and the CGF board 313, thereby adding a reinforcing function. A perlite concrete 312 may be provided in the CGF board 313. Here, the bottom projection 314 may be Ni steel of 9% or 7% so as to protect the tank and enhance the strength and durability of the tank.

The side heat insulating part 32 may function to heat-insulate between the side of the inner tank 200 and the side of the outer tank 100. The side heat insulating part 32 has a layer structure in which a glass wool blanket (GWB) 323, a perlite 322, and a polyurethane foam (PUF) 321 are sequentially stacked in the direction toward the outside from the inner tank 200, thereby maximizing the heat insulating function.

The perlite 322 is a component that performs heat insulation to block the temperature of liquid stored in the inner tank 200 to be delivered to the outside. The perlite 322 may be provided between the inner tank 200 and the sandwich plate 102. The perlite 322 may be provided, for example, by baking gemstone (pearlstone) made of volcanic rock at a high temperature (e.g., 1200° C.).

The corner heat insulating part 33 may function to heat-insulate between a corner of the inner tank 200 and a corner of the outer tank 100. Since a structural weakness exists at a point at which the bottom heat insulating part 31 and the side heat insulating part 32 meet each other, the corner heat insulating part 33 may be additionally provided with a corner insulation 331 and a corner protection 332 so as to overcome the weakness and maximize heat insulation effects. Here, the corner insulation 331 may made of CGF, and the corner protection 332 may be made of Ni steel of 9% or 7%.

The layer structures in the bottom heat insulating part 31, the side heat insulating part 32, and the corner heat insulating part 33 may be connected through adhering. The above-described configurations and structures are provided as an embodiment for describing the configuration of the present invention, and the present invention is not limited thereto.

A space is formed in the inner tank 200 to store a storage material (e.g., liquefied natural gas or oil) such as liquid or gas, thereby constituting an inner tank. In the embodiment of the present invention, the inner tank 200 may be an independent type tank. For example, the independent type tank is of a type in which, since the independent type tank is independent from the sandwich plate 102, the independent type tank maintains a pressure for autonomously storing a storage material therein, thereby receiving the weight of the storage material. For example, the independent type tank may be a moss type tank. A general configuration is used as the detailed structure of the independent type tank, and therefore, a detailed description of the independent type tank will be omitted.

The inner tank 200 will be described with reference to FIG. 8. In FIG. 8, FIG. 8A is a perspective view of an inner tank according an embodiment of the present invention. FIG. 8B is an internal perspective view of the inner tank according to the embodiment of the present invention. FIG. 8C is a sectional view of the inner tank according to the embodiment of the present invention.

Referring to FIGS. 8A to 8C, the outer surface of the inner tank 200 is configured with an inner tank top surface 201, an inner tank side surface 202, and an inner tank bottom surface 203, and the inside of the inner tank 200 may be configured with an inner tank first frame (preferably, a horizontal ring frame) 205, an inner tank second frame (preferably, a transverse web frame) 206, an inner tank first partition wall (preferably, transverse swash BHD) 207, and an inner tank second partition wall (preferably, longitudinal swash BHD) 208. In addition, the inner tank 200 may be additionally provided with an inner tank reinforcing member 204 so as to enhance the durability and stiffness of the inner tank 200.

Here, a pump tower (not shown) for discharging the storage material stored in the inner tank 200 may be installed in the inner tank 200. In this case, the inner tank 200 may form a closed structure to be in a state in which its internal space is isolated from the outside at ordinary times when the pump tower is not operated. The inner tank 200 may be formed in a polygonal shape. For example, the inner tank 200 may have a rectangular parallelepiped shape or a cylindrical shape.

The inner tank 200 may be located over a heat insulation structure (reference numeral not shown) installed on the ground (reference numeral not shown) in the state in which the inner tank 200 has been completely manufactured. Here, the heat insulation structure may be the outer tank slab 103, but the present invention is not limited thereto.

The inner tank 200 may include holding parts 209. The holding parts 209 will be described in detail later with reference to FIG. 10. FIG. 10 is a conceptual view illustrating when each of the ground liquefied natural gas storage tanks 1 and 2 is installed by the transportation means 40 according to the embodiment of the present invention.

Referring to FIG. 10, the holding part 209 may be formed to extend outward from the bottom at a lower corner of the inner tank 200. The holding part 209 may be formed outward of the surface of the inner tank 200, which is connected to the outer tank slab 103.

In the embodiment of the present disclosure, the inner tank 200 is to be transported to the outer tank slab 103 previously installed over the supports 10 formed to extend upward from the ground, and therefore, it is difficult to transport the inner tank 200 to the outer tank slab 103 after the transportation means 40 is located immediately under the inner tank 200. Accordingly, the inner tank 200 may be provided with the holding parts 209 so as to effectively transport the inner tank 200 to a desired position of the outer tank slab 103 as the transportation means 40 are located at both side surfaces of the inner tank tank 200 and then moved along both sides of the outer tank slab 103.

In order to obtain the above-described effect, the holding part 209 is formed to extend outward from the bottom at a lower corner of the inner tank 200, or is formed outward of the surface of the inner tank 200, which is connected to the outer tank slab 103. The holding part 209 may serve as a holder for allowing the transportation means 40 to put the inner tank 200 thereon.

As described above, in each of the ground liquefied natural gas storage tanks 1 and 2 according to the first and second embodiments of the present invention, the sandwich plate 102 can be modularized and constructed without installing or dismantling any separate mold (not shown). Thus, the number of processes for installation is decreased, and the required labor is reduced, thereby saving cost and reducing a construction term. Accordingly, it is possible to easily install the ground liquefied natural gas storage tank even in severe cold regions such as polar regions, and regions in which manpower supply is insufficient.

In addition, the external reinforcing member 20 is added to the sandwich plate 102, so that it is possible to enhance the durability or impact resistance of the sandwich plate 102 and to remarkably reduce the weight of the sandwich plate 102. Accordingly, the modularized construction method can be efficiently performed, and simultaneously, material cost can be reduced, thereby saving construction cost.

In addition, the thickness of the sandwich plate 102 can be decreased, so that it is possible to simply and easily install a hole (not shown) for discharging a storage material to the outside therethrough.

Figure 11:
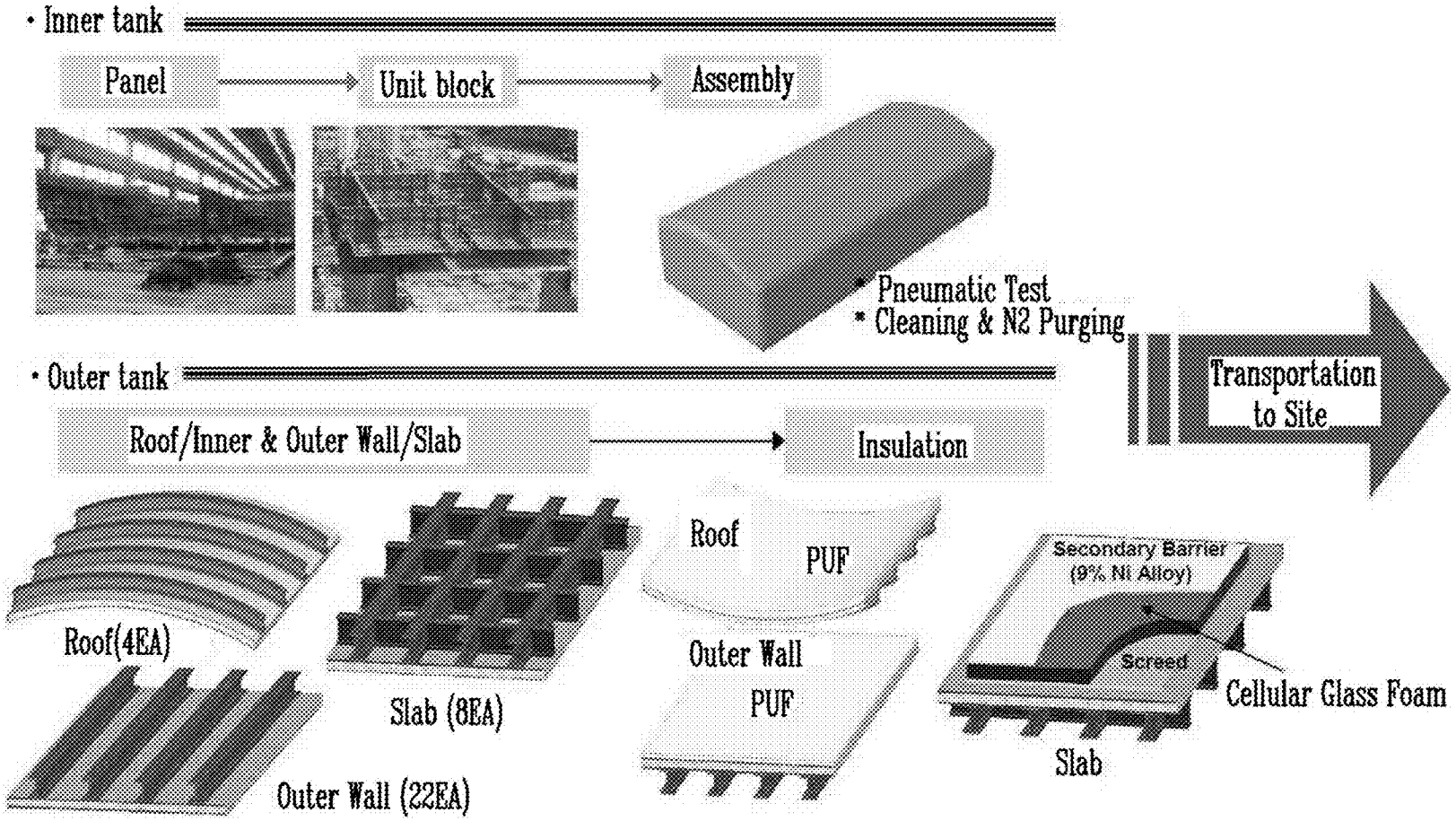
FIG. 11 is a first step view illustrating an installation step of a ground liquefied natural gas storage tank according to an embodiment of the present invention.
Figure 12:
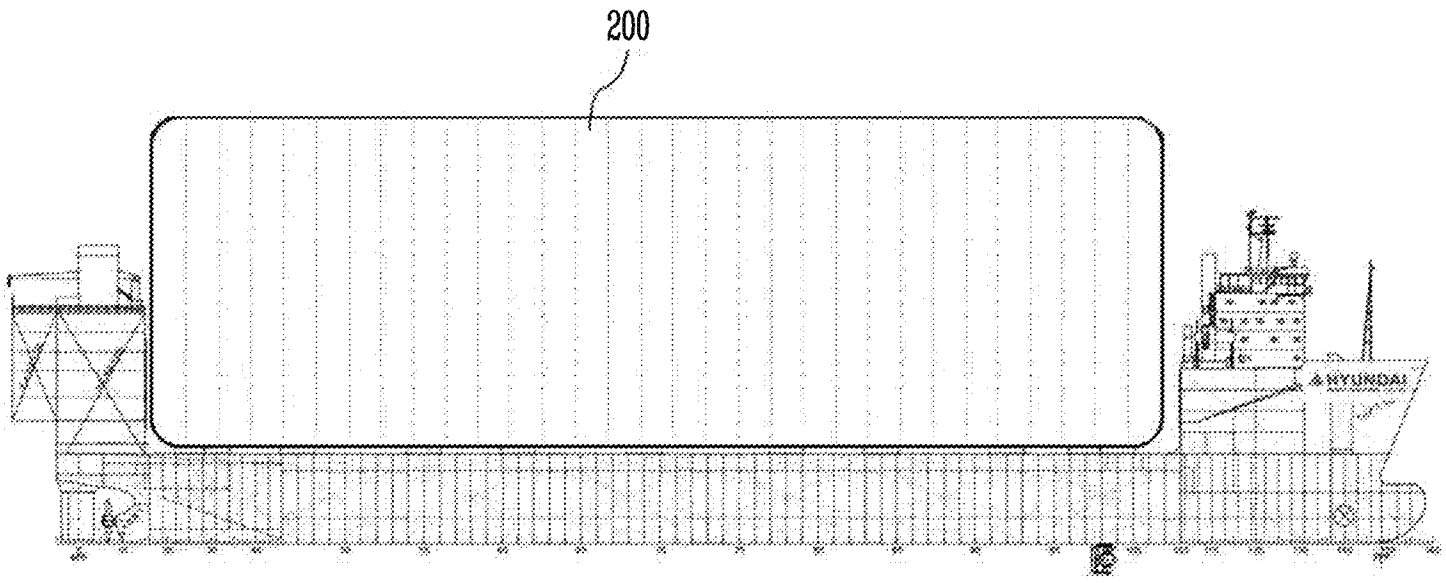
FIG. 12 is a second step view illustrating the installation step of the ground liquefied natural gas storage tank according to the embodiment of the present invention.
Figure 13:
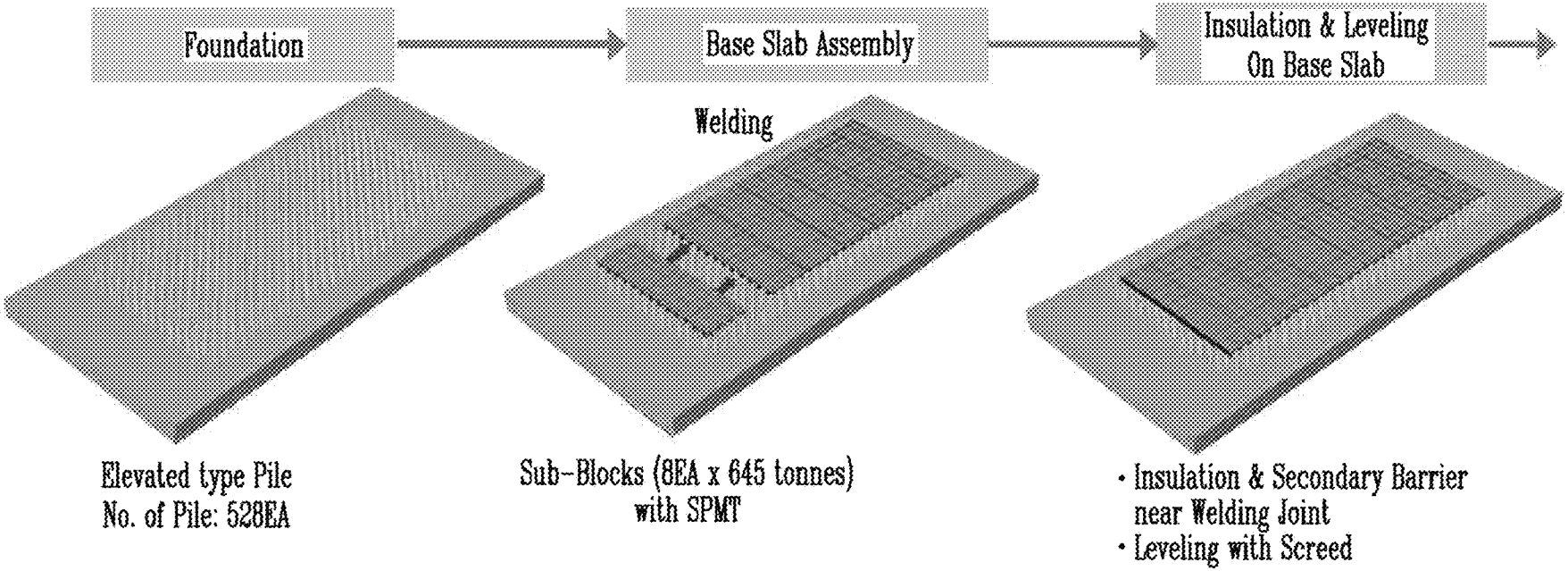
FIG. 13 is a third step view illustrating the installation step of the ground liquefied natural gas storage tank according to the embodiment of the present invention.
Figure 14:
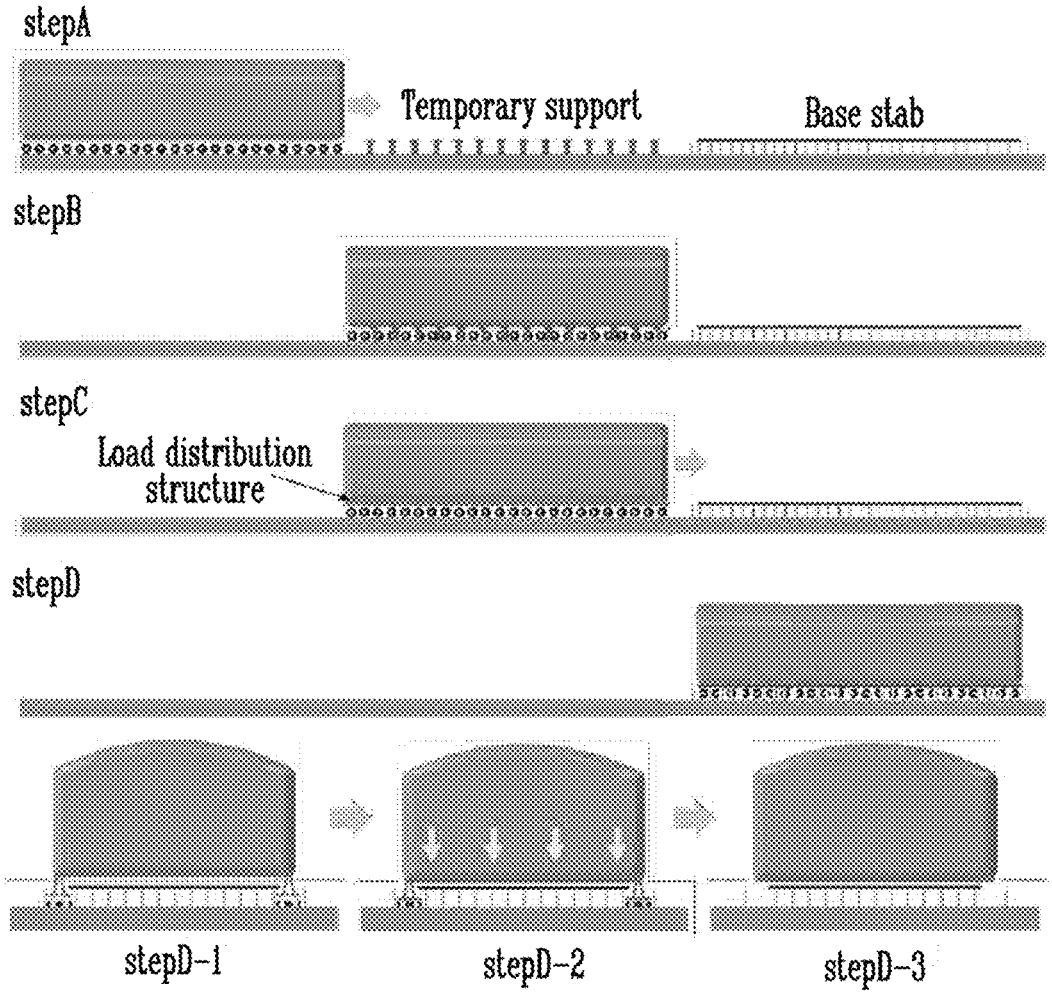
FIG. 14 is a fourth step view illustrating the installation step of the ground liquefied natural gas storage tank according to the embodiment of the present invention.
Figure 15:
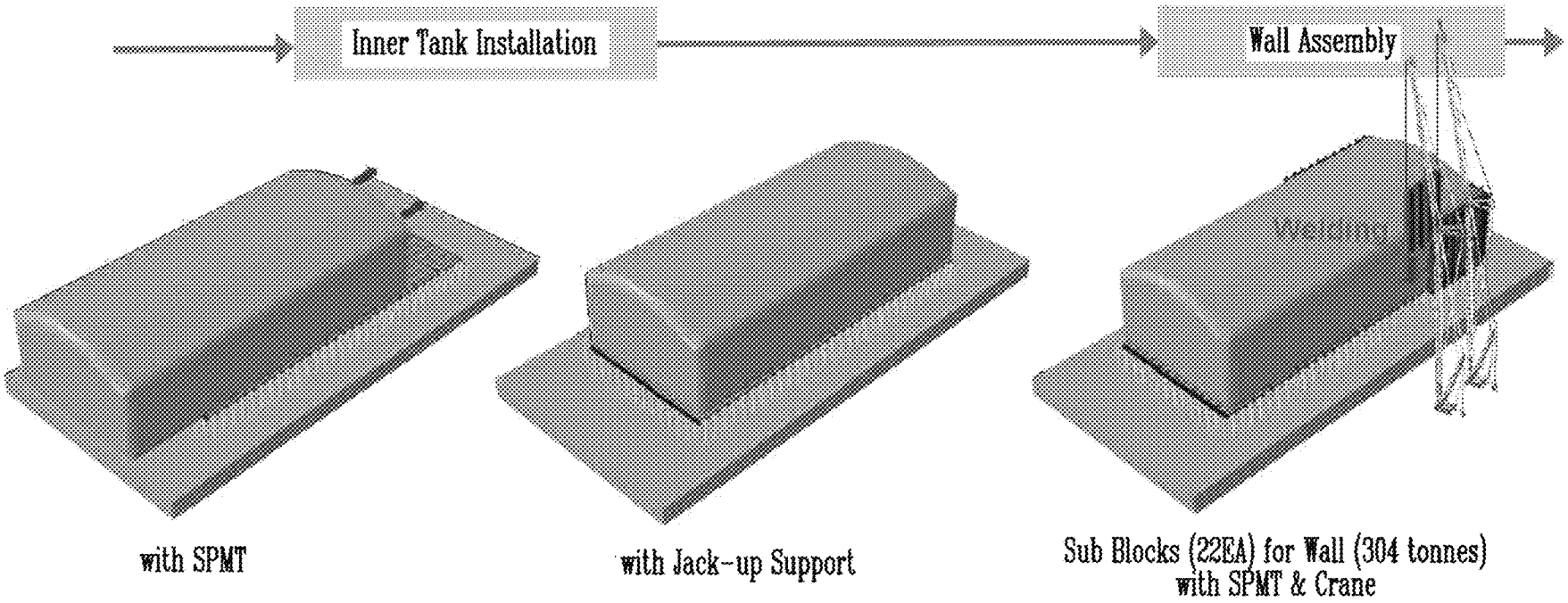
FIG. 15 is a fifth step view illustrating the installation step of the ground liquefied natural gas storage tank according to the embodiment of the present invention.
Figure 16:
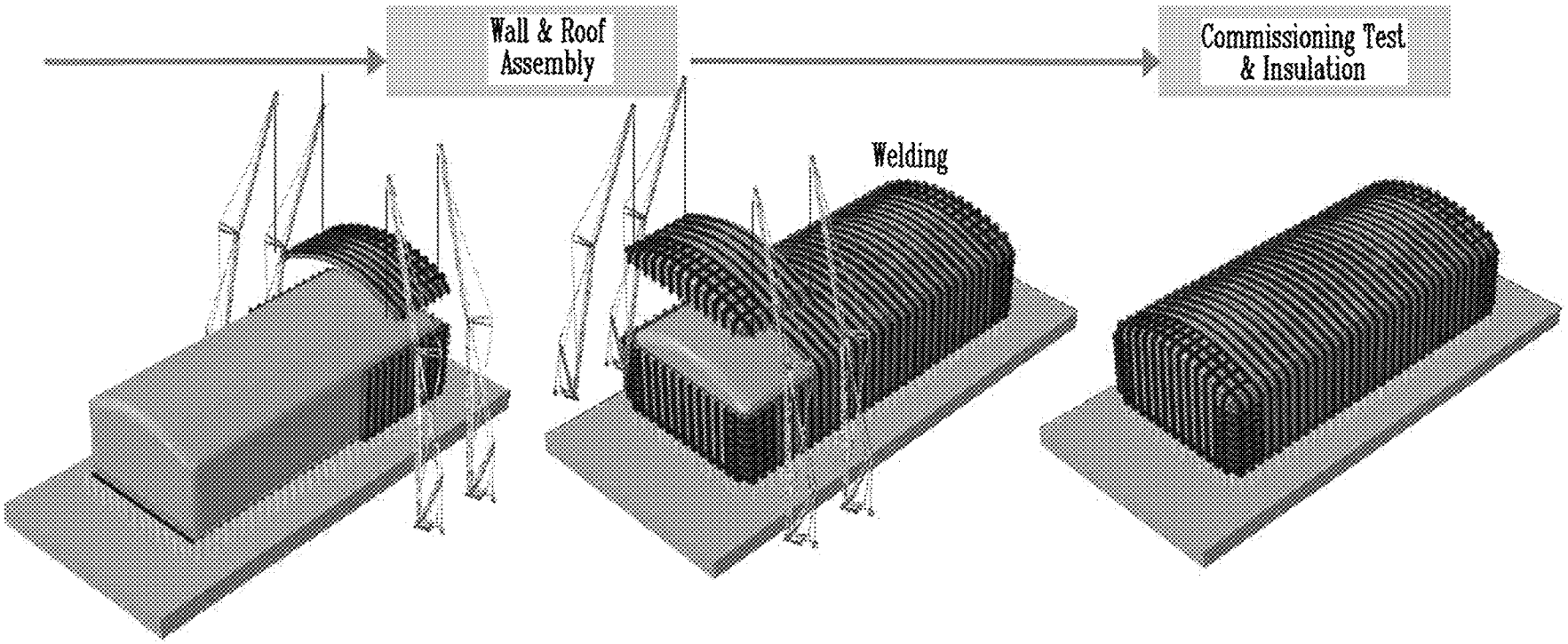
FIG. 16 is a sixth step view illustrating the installation step of the ground liquefied natural gas storage tank according to the embodiment of the present invention.

FIG. 11 is a first step view illustrating an installation step of a ground liquefied natural gas storage tank according to an embodiment of the present invention. FIG. 12 is a second step view illustrating the installation step of the ground liquefied natural gas storage tank according to the embodiment of the present invention. FIG. 13 is a third step view illustrating the installation step of the ground liquefied natural gas storage tank according to the embodiment of the present invention. FIG. 14 is a fourth step view illustrating the installation step of the ground liquefied natural gas storage tank according to the embodiment of the present invention. FIG. 15 is a fifth step view illustrating the installation step of the ground liquefied natural gas storage tank according to the embodiment of the present invention. FIG. 16 is a sixth step view illustrating the installation step of the ground liquefied natural gas storage tank according to the embodiment of the present invention. These illustrate a method for manufacturing the ground liquefied natural gas storage tank according to the embodiment of the present invention to be easily viewed at a glance. The method for manufacturing the ground liquefied natural gas storage tank according to the embodiment of the present invention will be briefly described at the end.

Figure 17:
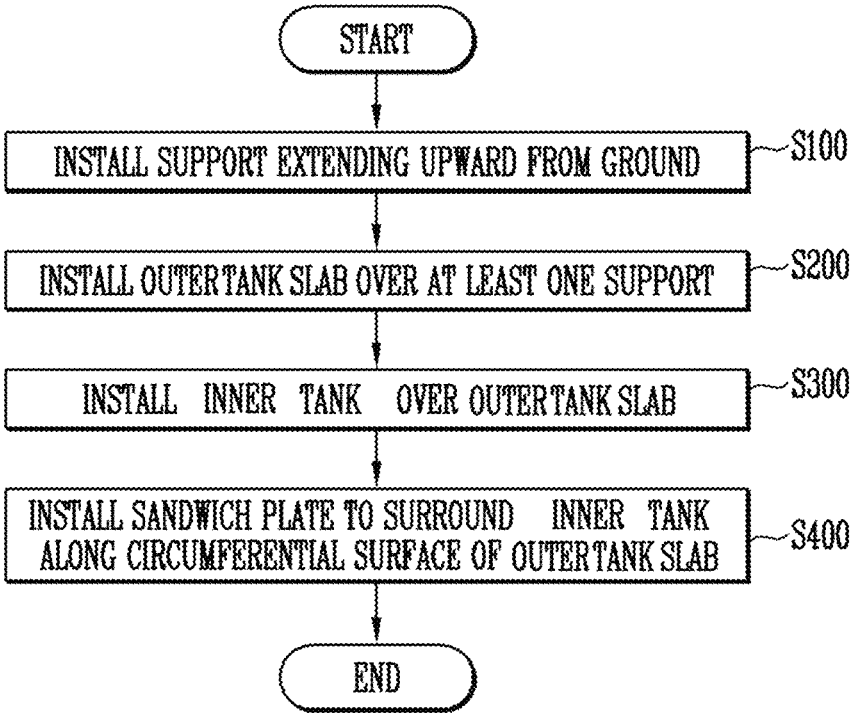
FIG. 17 is a flowchart of a method for manufacturing the ground liquefied natural gas storage tank according to the embodiment of the present invention.
Figure 18:
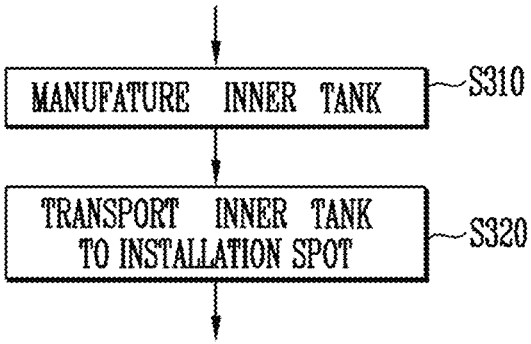
FIG. 18 is a first partial flowchart of the method for manufacturing the ground liquefied natural gas storage tank according to the embodiment of the present invention.
Figure 19:
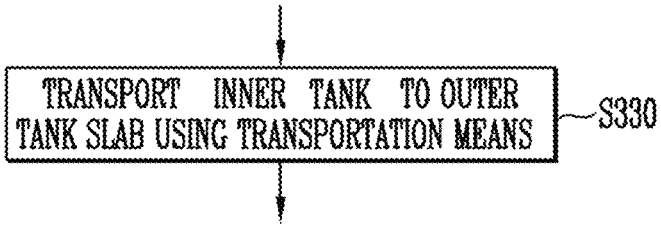
FIG. 19 is a second partial flowchart of the method for manufacturing the ground liquefied natural gas storage tank according to the embodiment of the present invention.
Figure 20:
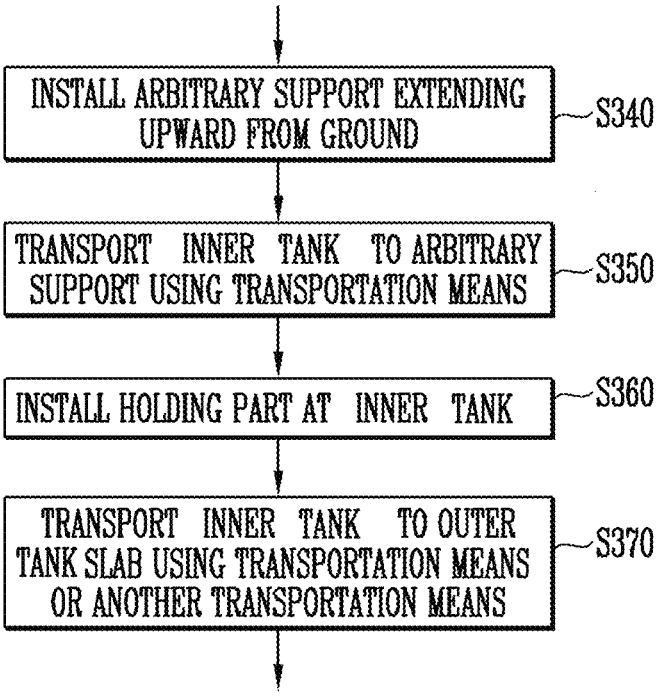
FIG. 20 is a third partial flowchart of the method for manufacturing the ground liquefied natural gas storage tank according to the embodiment of the present invention.
Figure 21:
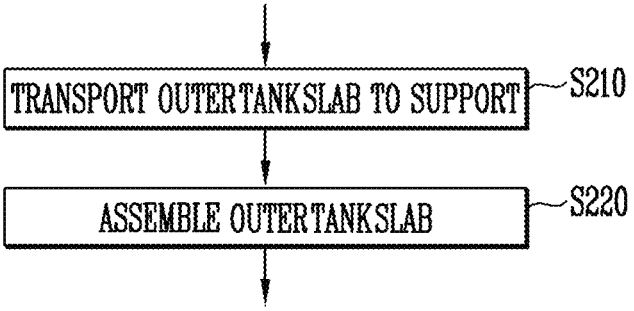
FIG. 21 is a fourth partial flowchart of the method for manufacturing the ground liquefied natural gas storage tank according to the embodiment of the present invention.
Figure 22:
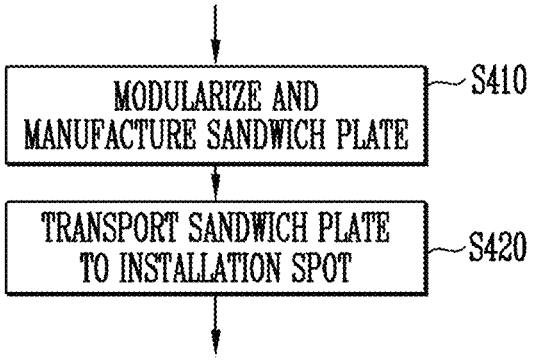
FIG. 22 is a fifth partial flowchart of the method for manufacturing the ground liquefied natural gas storage tank according to the embodiment of the present invention.
Figure 23:
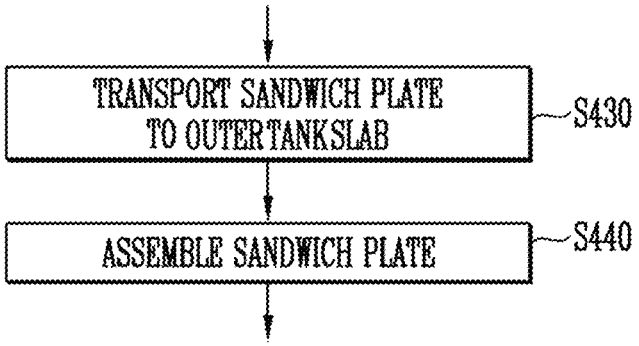
FIG. 23 is a sixth partial flowchart of the method for manufacturing the ground liquefied natural gas storage tank according to the embodiment of the present invention.
Figure 24:
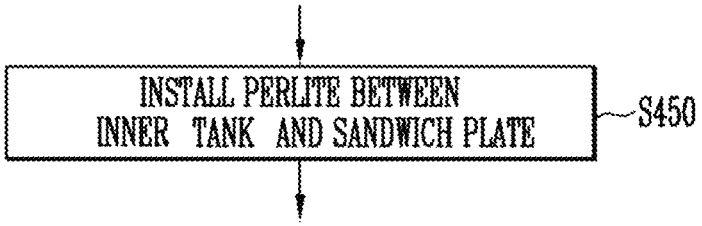
FIG. 24 is a seventh partial flowchart of the method for manufacturing the ground liquefied natural gas storage tank according to the embodiment of the present invention.
Figure 25:
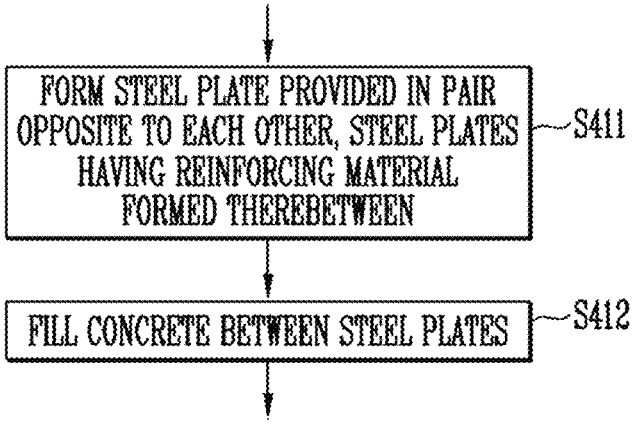
FIG. 25 is an eighth partial flowchart of the method for manufacturing the ground liquefied natural gas storage tank according to the embodiment of the present invention.

FIG. 17 is a flowchart of the method for manufacturing the ground liquefied natural gas storage tank according to the embodiment of the present invention. FIG. 18 is a first partial flowchart of the method for manufacturing the ground liquefied natural gas storage tank according to the embodiment of the present invention. FIG. 19 is a second partial flowchart of the method for manufacturing the ground liquefied natural gas storage tank according to the embodiment of the present invention. FIG. 20 is a third partial flowchart of the method for manufacturing the ground liquefied natural gas storage tank according to the embodiment of the present invention. FIG. 21 is a fourth partial flowchart of the method for manufacturing the ground liquefied natural gas storage tank according to the embodiment of the present invention. FIG. 22 is a fifth partial flowchart of the method for manufacturing the ground liquefied natural gas storage tank according to the embodiment of the present invention. FIG. 23 is a sixth partial flowchart of the method for manufacturing the ground liquefied natural gas storage tank according to the embodiment of the present invention. FIG. 24 is a seventh partial flowchart of the method for manufacturing the ground liquefied natural gas storage tank according to the embodiment of the present invention. FIG. 25 is an eighth partial flowchart of the method for manufacturing the ground liquefied natural gas storage tank according to the embodiment of the present invention. The method for manufacturing the ground liquefied natural gas storage tank according to the embodiment of the present invention may be implemented by each of the ground liquefied natural gas storage tanks 1 and 2 according to the first and second embodiments of the present invention, which are described above. Hereinafter, each step of the method for manufacturing the ground liquefied natural gas storage tank according to the embodiment of the present invention will be described.

As shown in FIGS. 17 to 25, the method for manufacturing the ground liquefied natural gas storage tank according to the embodiment of the present invention includes: a step (S100) of installing at least one support 10 extending upward from the ground (reference numeral not shown); a step (S200) of installing an outer tank slab 103 over the supports 10; a step (S300) of installing an inner tank 200 over the outer tank slab 103; and a step (S400) of installing a sandwich plate 102 to surround the inner tank 200 along the circumferential surface of the outer tank slab 103.

In the method for manufacturing the ground liquefied natural gas storage tank according to the embodiment of the present invention, each of the ground liquefied natural gas storage tanks 1 and 2, which is installed in each step, includes an external reinforcing member 20 formed on the outer surface of the sandwich plate 102. The external reinforcing member 20 may be provided to at least one of the sandwich plate 102 and the outer tank slab 103.

In step S100, the support 10 extending upward from the ground (not shown) is installed. This is a foundation construction for solidifying the ground. For example, a plurality of iron pipe wedges (also referred to as "piles") may be hit on the ground so as to prevent earthquake or impact. In this case, the support 10 may be an elevated type support. The support 10 may be a bar type, H-beam type or pipe type support, or a pile.

When the support 10 is installed, a plurality of supports are installed to be spaced apart from each other, and the spacing distance between the supports may be changed depending on design. However, the spacing distance between a column of supports 10 facing a column of outermost supports among the supports 10 installed to be spaced apart from each other and the column of outermost supports may be installed to be equal to or greater than the left-right length of a transportation means 40.

In step S200, the outer tank slab 103 is installed over the support 10. After the installation of the support 10 is completed, the outer tank slab 103 may be installed over the support 10.

The outer tank slab 103 prevents heat from being supplied into each of the ground liquefied natural gas storage tanks 1 and 2 or prevents cold heat from being conducted to the outside. The outer tank slab 103 may be a foam board (not shown), or may be formed by a sandwich concrete plate (SCP) method.

The foam board may be formed by foaming synthetic resin in the shape of a flat plate. The foam board may constitute a grid-shaped frame to endure a load caused by a storage material in a tank (not shown). In addition, the foam board may be formed by foaming synthetic resin after the frame is disposed over the bottom. Alternatively, after the foam board is previously formed as a flat-plate-shaped structure, the foam board may be disposed over the bottom to be assembled:

The SCP method for forming the outer tank slab 103 is similar to a method for forming the sandwich plate 102, and therefore, the method for forming the outer tank slab 103 will be replaced with the method for forming the sandwich plate 102, which will be described later.

Here, the step of installing the outer tank slab 103, as shown in FIG. 21, may additionally include: a step (S210) of transporting the outer tank slab 103 to the support 10; and a step (S220) of assembling the outer tank slab 103.

In step S210, the outer tank slab 103 is transported to the support 10. The outer tank slab 103 may be modularized and manufactured on a production site to be transported by the transportation means 40 to an installation site. Then, the outer tank slab 130 may be located over the support 10 by the transportation means 40. In addition, the outer tank slab 103 may directly manufactured at the installation place to be located over the support 10 by the transportation means 40.

In step S220, the outer tank slab 103 is assembled. The outer tank slab 103 located over the support 10 by the transportation means 40 may be assembled through welding.

In step S300, the inner tank tank 200 is installed over the outer tank slab 103. After the installation of the outer tank slab 103 over the support 10 is completed, the tank 200 may be installed over the outer tank slab 103.

Here, the step of installing the inner tank 200, as shown in FIGS. 18 and 19, may include: a step (S310) of manufacturing the inner tank 200; a step (S320) of transporting the inner tank 200 to the installation site; and a step (S330) of transporting the inner tank 200 to the outer tank b slab 103 using the transportation means 40.

In step S310, the inner tank 200 is manufactured. The inner tank 200 may be directly manufactured on the production site. This is identical to the production of a general inner tank, and therefore, its detailed description will be omitted.

In step S320, the inner tank 200 is transported to the installation site. The inner tank 200 may be transported to the installation site by the transportation means 40 (e.g., a ship, etc.).

In step S330, the inner tank 200 is transported to the outer tank slab 103 using the transportation means 40. The inner tank 200 transported to the installation site may be located over the outer tank slab 103 by the transportation means 40 (e.g., a transporter, an SPMT, etc.). In this case, the transportation means 40 may install the inner tank 200 over the outer tank slab 103 by locating the inner tank 200 over the outer tank slab 103, putting down the inner tank 200 over the outer tank slab 103, and then retreating.

In addition, the step of installing the inner tank 200 will be described in detail. As shown in FIG. 20, the step of installing the inner tank 200 may include: a step (S340) of installing an arbitrary support (not shown) extending upward from the ground; a step (S350) of transporting the inner tank 200 to the arbitrary support using the transportation means 40; a step (S360) of installing a holding part 209 at the inner tank 200; and a step (S370) of transporting the inner tank 200 to the outer tank slab 103 using the transportation means 40 or another transportation means (reference numeral not shown).

In step S340, the arbitrary support (not shown) extending upward from the ground is installed. The arbitrary support may be installed to be located in the vicinity of the support 10 over which the outer tank slab 103 is installed. The arbitrary support may include various types of supports to arbitrarily support the inner tank 200. Preferably, the arbitrary support is an elevated type support, and may be a bar type, H-beam type or pipe type support.

In step S350, the inner tank 200 is transported to the arbitrary support using the transportation means 40. The inner tank 200 may be located over the arbitrary support by another transportation means (e.g., a transporter, etc.). In this case, the transportation means 40 may install the inner tank 200 over the arbitrary support by locating the inner tank 200 over the arbitrary support, putting down the inner tank 200 over the arbitrary support, and then retreating.

In step S360, the holding part 209 is installed at the inner tank 200. The holding part 209 formed to extend outward from the bottom at a lower corner of the inner tank 200 or formed outward of the surface of the inner tank 200 which is connected to arbitrary support, may be installed at the inner tank 200 located over the arbitrary support.

In step S370, the inner tank 200 is transported to the outer tank slab 103 using the transportation means 40 or another transportation means (not shown). The inner tank 200 at which the holding part 209 is installed over the arbitrary support may be transported to the outer tank slab 103 by being moved along the outside of the outer tank slab 103 by the another transportation means.

In step S400, the sandwich plate 102 is installed to surround the inner tank 200 along the circumferential surface of the outer tank slab 103.

Here, the step of installing the sandwich plate 102, as shown in FIGS. 22 to 24, may include: a step (S410) of manufacturing the sandwich plate 102; a step (S420) of transporting the sandwich plate to the installation site; a step (S430) of transporting the sandwich plate 102 to the outer tank slab 103; a step (S440) of assembling the sandwich plate 102; and a step (S450) of installing a perlite 322 between the inner tank 200 and the sandwich plate 102.

In step S410, the sandwich plate 102 is manufactured.

here, the step of manufacturing the sandwich plate 102, as shown in FIG. 25, may further include: a step (S411) of forming a steel plate 130 provided in a pair opposite to each other, the steel plates 130 having a reinforcing material (front connecting member 110) formed therebetween; and a step (S412) of filling a concrete 120 between the steel plates 130.

In step S411, the steel plates 130 are formed. The steel plate 130 may be provided in a pair of plate shapes opposite to each other, and a plurality of front connecting members 110 may he connected between the steel plates 130 to be at right angles to the steel plates 130. In this case, the front connecting member 110 may be integrally formed with the pair of steel plates 130 by connecting the pair of steel plates 130 to each other. The steel plates 130 may configured as a portion of an outer tank while guiding the shape of the filler (concrete 120) to be formed.

In step S412, the concrete 120 is filled between the steel plates 130. The durability, noise insulation, and fire resistance of the concrete 120 is high as compared with a wall body made of a general cement material, and hence it can be minimized that an external stimulus is delivered to a liquid stored in the inner tank 200 or that the temperature of the liquid is delivered to the outside. The concrete 200 is a mixture in which several materials (sand, pebble, aggregate, cement, etc.) are mixed together with water to be solidified. The shape in which the concrete 200 is solidified as time elapses after the concrete 200 is injected between the steel plates 130 is formed to correspond to the shape of a space between the steel plates 130. The sandwich plate 102 is manufactured through the above-described steps.

In step S420, the sandwich plate 102 is transported to the installation site. The sandwich plate 102 may be transported from the production site to the installation site by the transportation means 40 (e.g., a ship, etc.).

In step S430, the sandwich plate 102 is transported to the outer tank slab 103. After the sandwich plate 102 is transported to the installation site, the sandwich plate 102 may be transported to the outer tank slab 103 by the transportation means 40 or another transportation means. In this case, the sandwich plate 102 is transported to the outer tank slab 103, to be located over the outer tank slab 103. Alternatively, the sandwich plate 102 may be transported in the vicinity of the outer tank slab 103 by the transportation means 40 and then located over the outer tank slab 103 through an equipment such as a crane or lifter.

In step S440, the sandwich plate 102 is assembled. As a plurality of sandwich plates 102 located over the outer tank slab 103 may connected to each other, the plurality of sandwich plates 102 may be assembled as an outer tank to surround the outer tank 100.

In step S450, the perlite 322 is installed between the inner tank 200 and the sandwich plate 102. After the sandwich plate 102 is formed as the outer tank while surrounding the inner tank 200, the perlite 322 may be installed between the inner tank 200 and the sandwich plate 102 so as to reinforce the heat insulation and impact resistance of each of the ground liquefied natural gas storage tanks 1 and 2. The perlite 322 may be provided, for example, by baking gemstone (pearlstone) made of volcanic rock at a high temperature (e.g., 1200° C.).

Hereinafter, the above-described method for manufacturing the ground liquefied natural gas storage tank according to the embodiment of the present invention will be briefly described with reference to FIGS. 11 to 16.

Referring to FIG. 11, in this step, the inner tank 200 and the outer tank 100 are simultaneously or sequentially manufactured on the production site. Here, the inner tank 200 is completed as a complete product by producing panels (reference numeral not shown), manufacturing the panels as unit blocks, and then assembling the unit blocks. However, in the case of the outer tank 100, the external reinforcing member 20 is added to the outer tank roof 101, the sandwich plate 102, and the outer tank slab 103, thereby completing modularizing and manufacturing on the production site (e.g., modularizing, as parts, the outer tank roof 101, the sandwich plate 102, and the outer tank slab 103). After that, a heat insulating process is performed on each of the modularized parts of the outer tank 100.

Referring to FIG. 12, in this step as the next step, the inner tank 200, the parts (the outer tank roof 101, the sandwich plate 102, and the outer tank slab 103) of the outer tank 100, and the like are transported to the installation site by a transportation means (e.g., a ship, etc.).

Referring to FIG. 13, in this step as the next step, a foundation is implemented by providing the support 10 on the ground, and the modularized outer tank slab 103 is assembled and completed over the support 10. Then, the heat insulating process is performed on the outer tank slab 103, and the outer tank slab 103 is stacked on the support 10.

Referring to FIG. 14, in this step as the next step, the inner tank 200 is located over the outer tank slab 103 through four steps.

In step A, the inner tank 200 is transported to the arbitrary support through the transportation means. In step B, the inner tank 200 is temporarily located over the arbitrary support. In step C, the holding part 209 is installed at the inner tank 200, and the inner tank 200 is lifted through another transportation means. In step D, the inner tank 200 is transported over the outer tank slab 103 from the arbitrary support through the another transportation means. Here, the step D will be described in detail. In step D-1, the inner tank 200 is located over the outer tank slab 103 through the another transportation means. In step D-2, the inner tank 200 is put down on the outer tank slab 103 through the another transportation means. In step D-3, the another transportation means is retreated from the outer tank slab 103.

Referring to FIG. 15, in this step as the next step, the previously manufactured inner tank 200 is located and installed over the outer tank slab 103 which has been completely assembled as shown in FIG. 14. After that, the previously manufactured modulated sandwich plates 102 are located to surround the outside of the inner tank 200, thereby connecting the sandwich plates 102 to each other.

Referring to FIG. 16, in this step as the last step, a process of connecting the sandwich plates 102 to each other to surround the inner tank 200 is performed using a lifter (reference numeral not shown) or a crane (reference numeral not shown), and simultaneously, the outer tank roof 101 is connected together with the sandwich plates 102. If the sandwich plates 102 and the outer tank roof 101 are installed to surround the outside of the inner tank 200 through the connecting process described above, thereby forming an outer tank, several tests (several stability tests including heat insulation, impact resistance, pressure resistance, etc.) for testing whether a storage material is to be safely stored are performed. Accordingly, each of the ground liquefied natural gas storage tanks 1 and 2 of the present invention is completed.

In the method for manufacturing the ground liquefied natural gas storage tank according to the embodiment of the present invention, each of the ground liquefied natural gas storage tanks 1 and 2 is modularized and manufactured as parts on the production site, the modularized parts are transported to the installation site, the inner tank 200 is first installed, and the outer tank 100 is then installed, so that it is possible to remarkably reduce a construction term and to maximize reduction in required labor.

Thus, the method for manufacturing the ground liquefied natural gas storage tank according to the embodiment of the present invention is a remarkable method that is distinguished from the conventional method for manufacturing a storage tank.

The conventional method for manufacturing the storage tank is divided into a ground type and an underground type. In the ground type, piles are hit on the ground, an outer tank (not shown) is formed using a mold (not shown), and a heat insulating member is then installed at the inner surface of the outer tank. In the underground type, the ground is dug to a certain depth, an outer tank (not shown) is installed, and an inner tank (not shown) is manufactured with a heat insulating member in the outer tank.

On the other hand, in the method for manufacturing the ground liquefied natural gas storage tank according to the embodiment of the present invention, in order to reduce the time required to form a space in which a tank is to be installed in the conventional method, the inner tank 200 and the sandwich plates 102 constituting the outer tank are separately manufactured, the inner tank 200 is located on the installation site, and the sandwich plates 102 are then assembled on the outer surface of the inner tank 200, thereby completing each of the ground liquefied natural gas storage tanks 1 and 2. Accordingly, it is possible to decrease the number of installation processes on the installation site.

As described above, in each of the ground liquefied natural gas storage tanks 1 and 2 of the present invention, the sandwich plate 102 can be modularized and constructed without installing or dismantling any separate mold (not shown). Thus, the number of processes for installation is decreased, and the required labor is reduced, thereby saving cost and reducing a construction term. Accordingly, it is possible to easily install the ground liquefied natural gas storage tank even in severe cold regions such as polar regions, and regions in which manpower supply is insufficient.

In addition, the external reinforcing member 20 is added to the sandwich plate 102, so that it is possible to enhance the durability, impact resistance, or heat insulation performance of the sandwich plate 102 and to remarkably reduce the weight of the sandwich plate 102. Accordingly, the modularized construction method can be efficiently performed, and simultaneously, material cost can be reduced, thereby saving construction cost.

In addition, the thickness of the sandwich plate 102 can be decreased, so that it is possible to simply and easily install a hole (not shown) for discharging a storage material to the outside therethrough.

While the present invention has been described with respect to the specific embodiments, this is for illustrative purposes only, and the present invention is not limited thereto. Therefore, it will be apparent to those skilled in the art that various changes and modifications may be made within the technical spirit and scope of the present invention.

Accordingly, simple changes and modifications of the present invention should also be understood as falling within the present invention, the scope of which is defined in the appended claims and their equivalents.

The invention claimed is:

1. A ground liquefied natural gas storage tank comprising;

an independent tank in which a space for storing a storage material is formed to constitute an inner tank;

a roof; at least one sandwich plate to comprise a pair of metal plates facing each other, the metal plates having a reinforcing material formed therebetween, and a filler filled between the metal plates, wherein the at least one sandwich plate surrounds the outer surface of the independent tank to constitute an outer tank;

at least one external reinforcing member formed on an outer surface of a wall body of the at least one sandwich plate, wherein the at least one external reinforcing member comprises a first longitudinal reinforcing member and a second lateral reinforcing member configured at a right angle to the first longitudinal reinforcing member; and at least one external reinforcing member formed on an outer surface of the roof, wherein the at least one external reinforcing member comprises a third reinforcing member and a fourth and fifth reinforcing member configured at a right angle to the third longitudinal reinforcing member and connected to the first longitudinal reinforcing member and the second lateral reinforcing member, wherein the independent tank is located over a ground heat insulation structure, and the at least one sandwich plate is transported and installed to surround the outer surface of the independent tank that has been completely manufactured.

2. The ground liquefied natural gas storage tank of claim 1, wherein the independent tank comprises a holding part formed to extend outward from the bottom at a lower corner of the independent tank.

3. The ground liquefied natural gas storage tank of claim 1, wherein the independent tank comprises a holding part formed outward of a surface connected to the heat insulation structure.

4. The ground liquefied natural gas storage tank of claim 1, further comprising an outer tank slab constituting the outer tank together with the at least one sandwich plate by covering the bottom of the at least one sandwich plate.

5. The ground liquefied natural gas storage tank of claim 4, further comprising an outer tank slab reinforcing member formed as a frame on the outer surface of the outer tank slab.

6. The ground liquefied natural gas storage tank of claim 4, further comprising at least one support supporting the outer tank slab from the ground.

7. The ground liquefied natural gas storage tank of claim 6, wherein the support is an elevated type support, and is a bar type, H-beam type or pipe type support, or a pile.

8. The ground liquefied natural gas storage tank of claim 6, wherein the at least one support are spaced apart from each other, and the spacing distance between a column of supports facing a column of outermost supports among the at least one support spaced apart from each other and the column of outermost supports is equal to or greater than the left-right length of a transportation means.

9. The ground liquefied natural gas storage tank of claim 1, further comprising a pump tower installed in the independent tank to discharge the storage material upward from the bottom of the independent tank.

10. The ground liquefied natural gas storage tank of claim 1, wherein the independent tank has a rectangular parallelepiped shape or a cylindrical shape.

11. The ground liquefied natural gas storage tank of claim 1, further comprising a perlite provided between the independent tank and the at least one sandwich plate.

* * * * *